US007658701B2

(12) United States Patent
Webb et al.

(10) Patent No.: US 7,658,701 B2
(45) Date of Patent: Feb. 9, 2010

(54) DUAL AXIS ABDOMINAL EXERCISE APPARATUS

(75) Inventors: Gregory M. Webb, Independence, VA (US); Roxanne C. Anders, Independence, VA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 11/867,538

(22) Filed: Oct. 4, 2007

(65) Prior Publication Data

US 2008/0085822 A1 Apr. 10, 2008

Related U.S. Application Data

(60) Provisional application No. 60/849,285, filed on Oct. 4, 2006.

(51) Int. Cl.
*A63B 23/02* (2006.01)

(52) U.S. Cl. ..... 482/140; 482/137

(58) Field of Classification Search ..... 482/93, 482/94, 98, 99, 100, 133–137, 140
See application file for complete search history.

(56) References Cited

U.S. PATENT DOCUMENTS

| | | | | |
|---|---|---|---|---|
| 4,387,893 | A * | 6/1983 | Baldwin | 482/137 |
| 4,600,196 | A | 7/1986 | Jones | |
| 4,725,056 | A | 2/1988 | Rehrl et al. | |
| 5,056,779 | A * | 10/1991 | Webb | 482/137 |
| 5,094,449 | A | 3/1992 | Stearns | |
| 5,324,247 | A | 6/1994 | Lepley | |
| 5,665,041 | A * | 9/1997 | Hsieh | 482/140 |
| 5,669,865 | A | 9/1997 | Gordon | |
| 5,692,997 | A * | 12/1997 | Stearns | 482/100 |
| 5,897,467 | A | 4/1999 | Habing et al. | |
| 5,938,575 | A * | 8/1999 | Stearns | 482/140 |
| 6,056,678 | A | 5/2000 | Giannelli et al. | |
| 6,120,416 | A | 9/2000 | Walker | |
| 6,186,926 | B1 * | 2/2001 | Ellis | 482/97 |
| 6,206,809 | B1 | 3/2001 | Habing et al. | |
| 6,517,468 | B1 | 2/2003 | Lapcevic | |
| 6,770,017 | B1 | 8/2004 | Leipheimer | |
| 6,884,203 | B2 * | 4/2005 | Forcillo | 482/142 |
| 6,966,872 | B2 * | 11/2005 | Eschenbach | 482/142 |
| 7,377,887 | B1 * | 5/2008 | Rosenow et al. | 482/134 |
| 7,384,383 | B2 * | 6/2008 | Forcillo et al. | 482/140 |
| 2008/0153677 | A1 | 6/2008 | Webber et al. | |

FOREIGN PATENT DOCUMENTS

DE G 94 11 573.7 U1 9/1994

OTHER PUBLICATIONS

Nautilus catalog, 92 pages (undated).

(Continued)

*Primary Examiner*—Fenn C Mathew
*Assistant Examiner*—Andrew M Tecco
(74) *Attorney, Agent, or Firm*—Dorsey & Whitney LLP

(57) ABSTRACT

An abdominal exercise apparatus is provided that includes at least a lower carriage, an upper carriage, and a frame supporting the lower and upper carriages. A linkage mechanism operably associates the upper and lower carriages together to allow coordinated movement relative to one another. The upper carriage includes an upper pivot axis relative to the frame, and an upper carriage pivot axis relative to the upper carriage, and the lower carriage includes a lower pivot axis relative to the frame.

18 Claims, 19 Drawing Sheets

OTHER PUBLICATIONS

"Nautilus Next Generation Product Line", Nautilus catalog, 8 pages, (undated).
"Nautilus Time Machine," Nautilus Inc., cover page of product brochure and one page therefrom, 2 pages (undated).
Nautilus Nitro® Abdominal SKU:S3AB, Nautilus, Inc., located at http://www.nautilus.com/catalog/product_detail_pring.jsp?contentName=/siteContent/Popu . . . , retrieved on Jul. 31, 2009, 2 pages.
Nautilus Nitro Abdominal parts diagram, Nautilus, Inc., located at http://download.dfxi.com/supportdocs/EV/Nautilus/S3-S5AB_Manual.PDF, retrieved on Aug. 4, 2009, unit orginally sold in the U.S. at least as early as 2000, 2 pages.
Nautilus Nitro Plus S5 Abdominal parts list, Nautilus, Inc., located at http://download.dfxi.com/supportdocs/EV/Nautilus/S3-S5AB_Manual.PDF, retrieved on Aug. 4, 2009, unit originally sold in the U.S. at least as early as 2000, 2 pages.

* cited by examiner

DUAL AXIS ABDOMINAL EXERCISE APPARATUS

CROSS REFERENCE TO RELATED APPLICATION

The present application claims the benefit under 35 U.S.C. § 119(e) to U.S. provisional patent application No. 60/849,285 ("the '285 application"), which was filed on Oct. 4, 2006 and entitled "Abdominal Exercise Apparatus." The '285 application is incorporated by reference into the present application in its entirety.

FIELD OF THE INVENTION

Aspects of the present invention relate to an abdominal exercise apparatus. More particularly, the present invention, in certain aspects, is an abdominal exercise apparatus that includes a motion defined by dual pivot axes, with the motion of the top and bottom portions controlled by four-bar linkage drive mechanisms. In another aspect, the four-bar linkage drive mechanisms are interconnected for coordinated movement.

BACKGROUND OF THE INVENTION

Abdominal exercise machines are popular amongst those exercisers desiring a strong core and preferring to perform machine-oriented exercise as opposed to sit-ups and other fundamental types of core exercises.

Abdominal exercise machines traditionally include a portion of the machine that moves to allow the user to contract his abdominal muscles. For instance, U.S. Pat. No. 4,387,893 describes a traditional clamshell structure with upper and lower movement arms that pivot toward each other about a single pivot axis. U.S. Pat. No. 5,056,779 describes an abdominal exercise machine with an upper movement arm that allows the user to contract his abdominal muscles.

Accordingly, there is a need to provide an abdominal exercise machine that includes upper and lower moving parts, with the parts moving in concert and in a manner that models or emulates the movement of a human spine during the contraction of the abdominal muscles.

BRIEF SUMMARY OF THE INVENTION

One aspect of the present invention encompasses an abdominal exercise apparatus having a frame, an upper carriage operably associated with the frame, a lower carriage operably associated with the frame, an upper control linkage operably associating the frame and the upper carriage, and a lower control linkage operably associating the frame and the lower carriage. The upper control linkage and the lower control linkage may be interconnected to cause the upper and lower carriages to move in concert with one another. Additionally the present invention may include dual pivot axes for allowing movement of the lower carriage and an upper carriage relative to the frame and in concert with one another, with the particular movement of the upper and lower carriages being controlled by an interconnected dual four-bar linkage drive system.

Another configuration of the present invention includes a frame, an upper carriage operably associated with the frame, a lower carriage operably associated with the frame, an upper control mechanism operably associated between the frame and the upper carriage, a lower control mechanism operably associated between the frame and the lower carriage, an upper pivot axis defined between the lower carriage and the frame, a lower pivot axis defined between the lower carriage and the frame; and wherein the upper control mechanism and the lower control mechanism are interconnected to cause the upper and lower carriages to move in concert with one another and with respect to the frame. A further configuration includes at least one additional pivot axis defined on the upper carriage. A further configuration includes a load assembly operably associated with either of the upper or lower carriages to apply a load when the exercise apparatus is used. Another configuration includes a lower carriage having a seat, and the upper carriage having a pad and arm rests.

A further configuration of the inventive features of the present invention include the upper control mechanism and the lower mechanism sharing a common pivot point on the frame.

Another configuration of the present invention includes a frame, an upper carriage operably associated with the frame, a lower carriage operably associated with the frame, an upper four-bar linkage mechanism operably associated between the frame and the upper carriage, a lower four-bar linkage mechanism operably associated between the frame and the lower carriage, the upper and lower four-bar linkage mechanisms sharing a common member, the member pivotally attached to the frame; and a load actuated by the motion of the common member.

Another configuration of the present invention includes a frame having opposing upright posts, an upper carriage operably associated with the opposing upright posts, a lower carriage operably associated with the opposing upright posts, an upper four-bar linkage mechanism operably associated between one of the posts and the upper carriage, a lower four-bar linkage mechanism operably associated between one of the posts and the lower carriage, the upper and lower four-bar linkage mechanisms sharing a common member, the member pivotally attached to the frame; and a load actuated by the motion of the common member.

These and other features and advantages of aspects of the present invention will become apparent to those skilled in the art from the following detailed description, wherein it is shown and described illustrative embodiments, including best mode(s) contemplated for carrying out the invention. As it will be realized, the various aspects of the invention are capable of modifications in various obvious respects, all without departing from the spirit and scope of the present invention. Accordingly, the drawings and detailed description are to be regarded as illustrative in nature and not restrictive.

DETAILED DESCRIPTION OF THE INVENTION

U.S. Pat. Nos. 4,387,893 and 5,056,779 are hereby incorporated by reference as if fully described herein.

Figure 2:
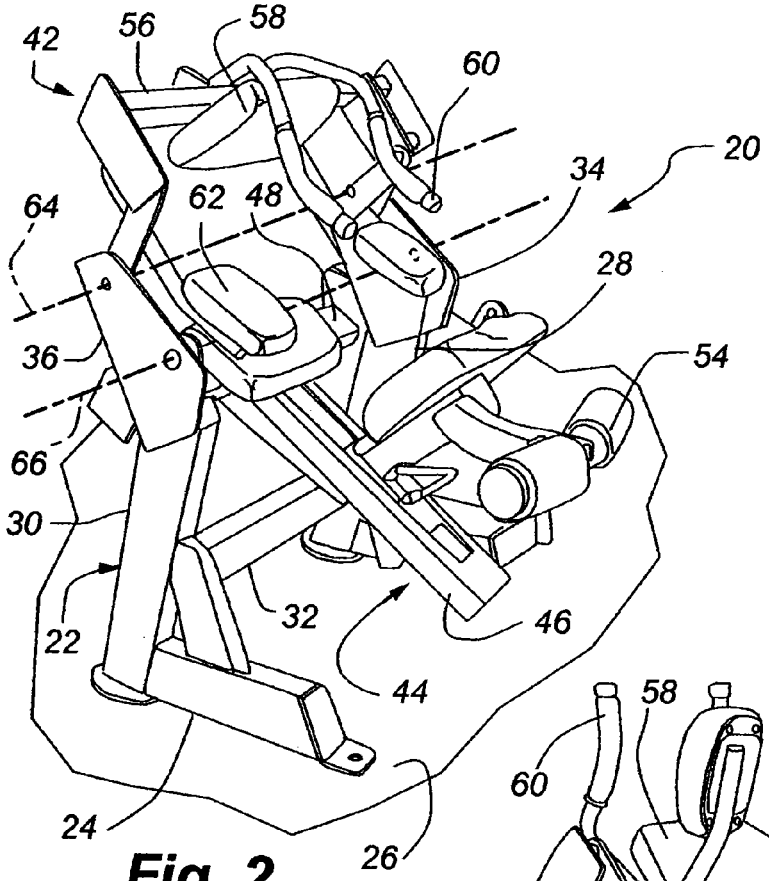
FIG. 2 is a front perspective view of the dual axis abdominal exercise machine of the present invention, in the closed position.
Figure 1:
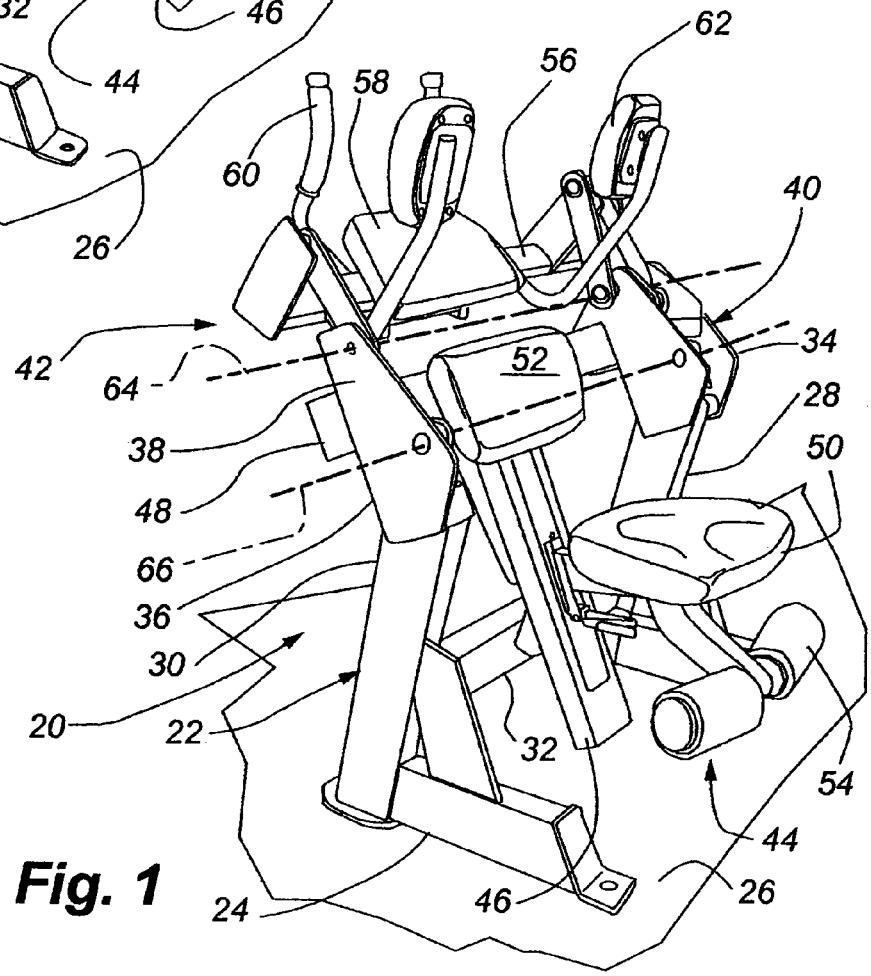
FIG. 1 is a front perspective view of the dual axis abdominal exercise machine of the present invention, in the open position.

An implementation of the abdominal exercise apparatus 20 of the present invention is shown in FIGS. 1 and 2. The apparatus 20 includes a frame 22 having a base 24 for resting on a support surface 26, such as a floor. The frame 22 includes laterally spaced uprights 28,30, and a lower crossbar 32 which acts to provide structural support to the laterally spaced uprights 28,30. Each laterally spaced upright 28, 30 includes a top portion 34, 36 for anchoring the pivot axes and supporting the movement mechanisms, as described below. The top portion 34 of the left upright 30 in the embodiment shown in FIG. 1 is a single plate structure 38. The top portion 36 of the right upright 28 in the embodiment shown in FIG. 1 is a dual plate structure 40. In this case the plates are parallel. The bottom portion of the uprights both extend rearwardly and upwardly from the base frame. The top portion of both uprights extends generally upwardly from the bottom portion. The rearward and upward extension of the uprights helps center the weight of the user in the center, front to back, of the machine, and allows for the motion of the carriages to not interfere with each other. Much of the movement mechanisms described below are positioned between the dual plates. The dual plate structure 40 provides support for various pivot axles extending between the plates, as described below.

An upper carriage 42 and a lower carriage 44 are each operatively associated with the frame 22 and positioned generally between the laterally spaced uprights 28,30. The lower carriage 44 has a main post 46 extending downwardly from an upper crossbar 48. As explained in greater detail below, the upper cross bar 48 is operatively associated with the uprights 28,30 by a movement mechanism. The lower carriage 44 includes a seat 50 and a backrest 52 attached to the post 46, along with restraining pads 54 extending downwardly and forwardly of the seat 50 for the user to tuck their legs behind during the exercise. The seat 50 is adjustable along the post 46 of the lower carriage 44, in an up and down movement, and may be adjustable in other ways as well. The backrest 52 and restraining pads 54 may also be adjustable on the lower carriage 44 in order to adjust for differing sizes of users.

The upper carriage 42 is operatively associated with the upper portions 34,36 of the laterally spaced uprights 28, 30. The upper carriage 42 includes a crossbar 56 to which is attached an upper torso/head pad 58, handles 60 extending over and forward from the head pad 58, and arm engagement pads 62 extending below and forward from the head pad (with reference to FIG. 1). Each of these features may be adjustable for differently sized users.

The upper carriage 42 and the lower carriage 44 are operably associated through movement mechanisms (also referred to as upper and lower control mechanisms) with one another to allow for movement in concert with one another. In other words, as one moves, the other one moves.

Each movement mechanism is a four-bar linkage drive mechanism, associated with each of the upper and lower carriages, to allow for movement of the upper 42 and lower 44 carriages relative to the frame. The lateral ends of the upper carriage 42 are operably associated with the respective lateral uprights 28,30 and define an upper pivot axis 64. The lateral ends of the lower carriage 44 are operably associated with the respective lateral uprights 28,30 and define a lower pivot axis 66. For instance, at least one pivot point in each of the upper and lower four-bar linkage drive mechanisms is formed on the frame. This will be explained in greater detail below.

FIG. 1 shows the abdominal machine 20 in the beginning or open position. FIG. 2 shows the abdominal machine 20 in the end or closed position. The relative change in position of both the upper 42 and lower 44 carriages is shown between these two figures. Between the open and closed positions, the upper carriage 42 has been pivoted or rotated about the upper pivot axis 64 in a downwardly direction, and the lower carriage 44 has been pivoted or rotated about the lower pivot axis 66 in an upwardly direction.

Figure 6:
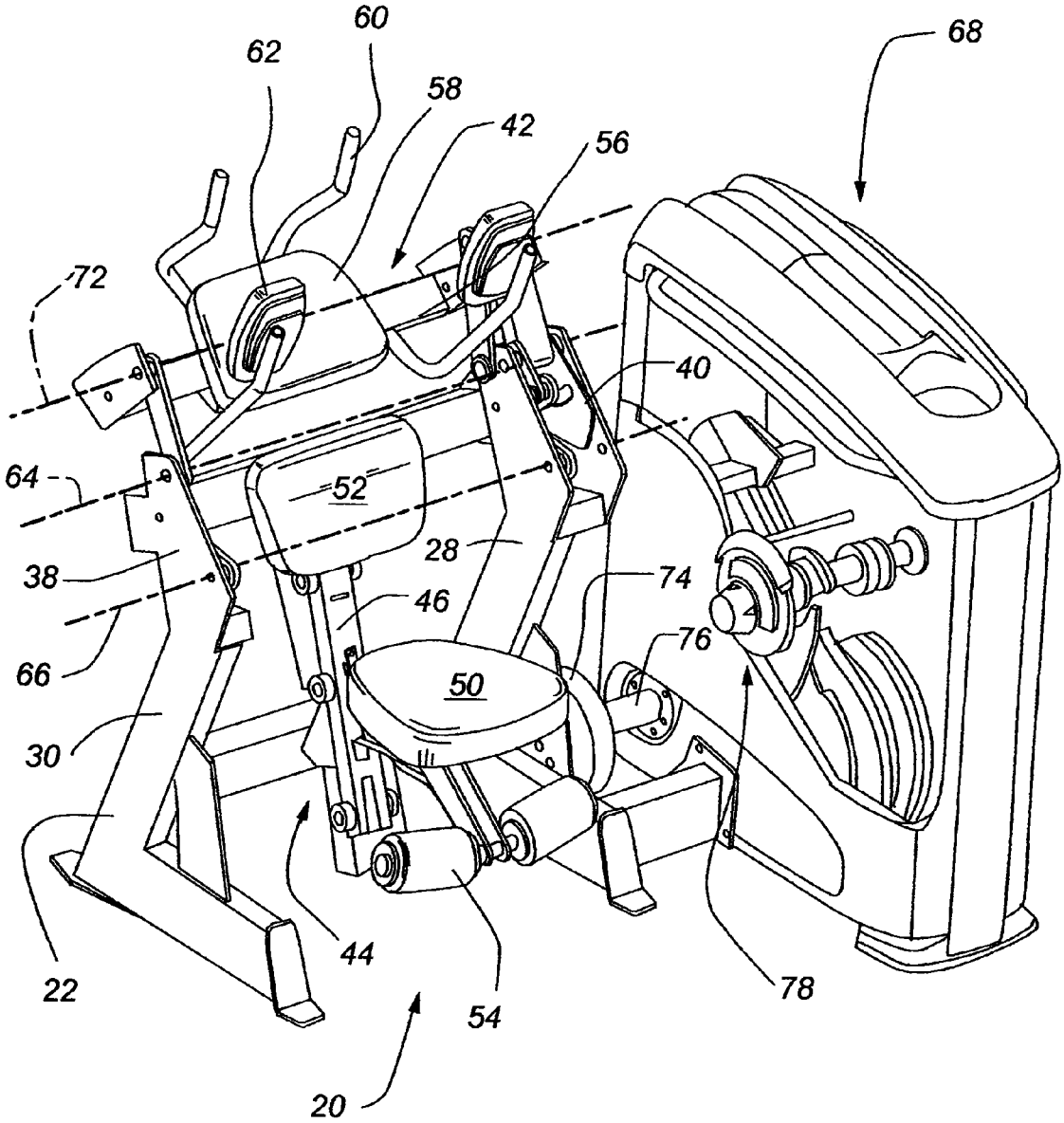
FIG. 6 is a front perspective view of the dual axis abdominal exercise machine of the present invention operably associated with a load mechanism.

A load may be applied by operably attaching either one of the moving carriages 42, 44, their respective movement mechanisms, or both, to a weight stack 68 (See FIG. 6). The weight stack 68 may be of any conventional structure, and may be attached to the abdominal machine 20 by a chain, cable, belt, or the like. It is contemplated that the abdominal machine 20 as disclosed here may also be used as a plate-loaded machine. It is also contemplated that the abdominal machine as disclosed may be used without any weight loading.

Figure 3:
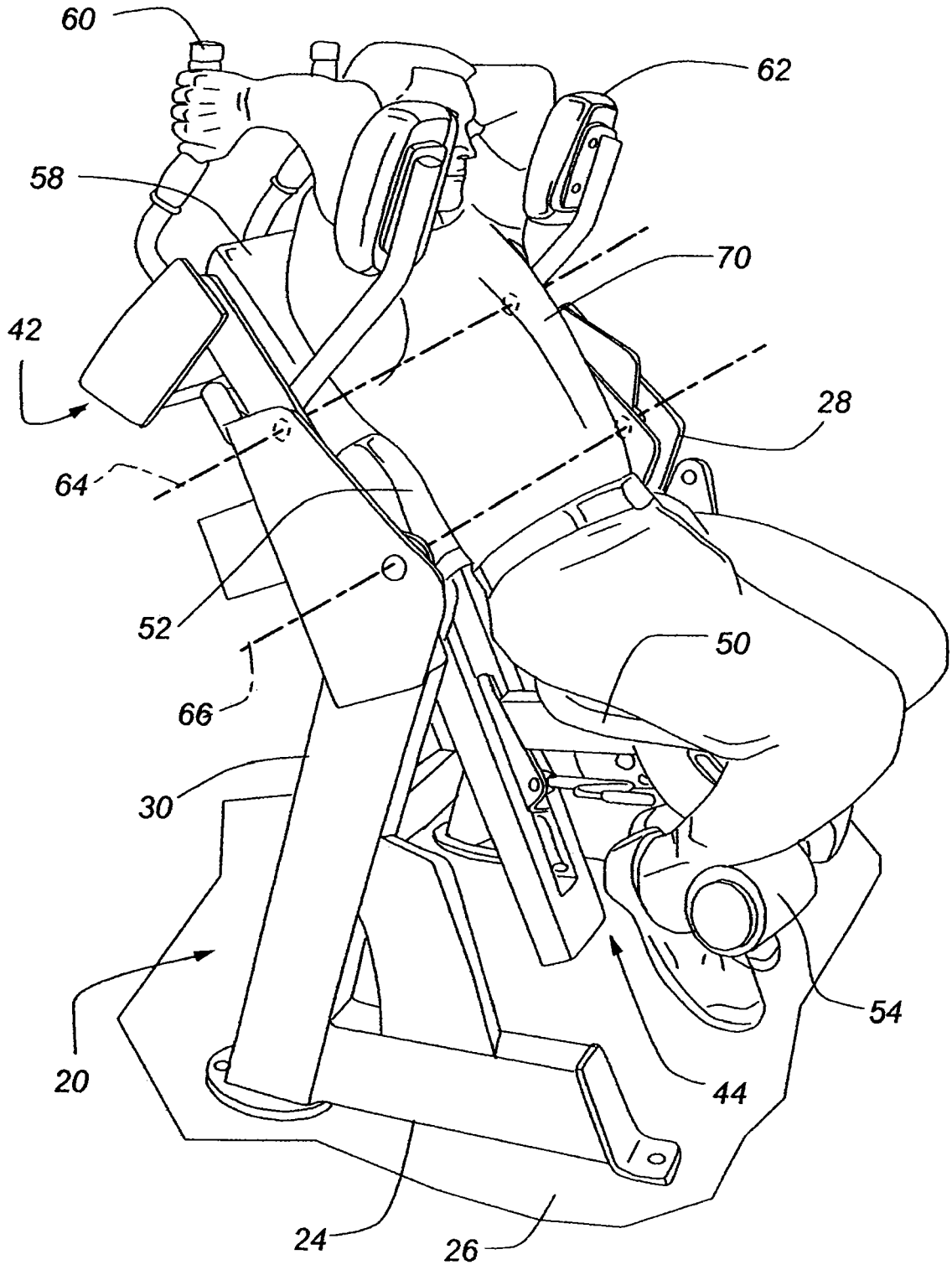
FIG. 3 is a front perspective view of the dual axis abdominal exercise machine of the present invention, in the open position with a user positioned thereon.
Figure 4:
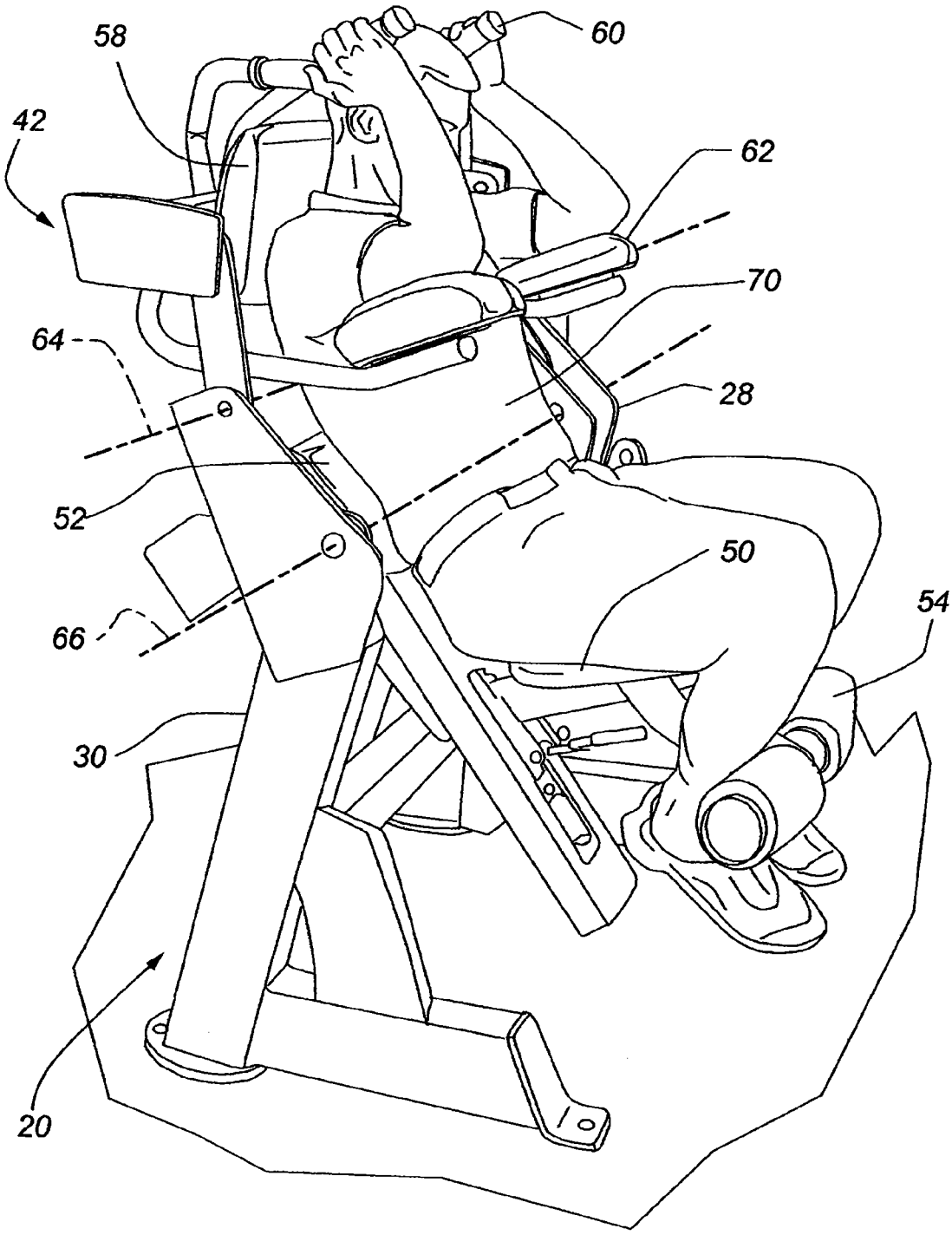
FIG. 4 is a front perspective view of the dual axis abdominal exercise machine of the present invention, in an intermediate position with a user positioned thereon.
Figure 5:
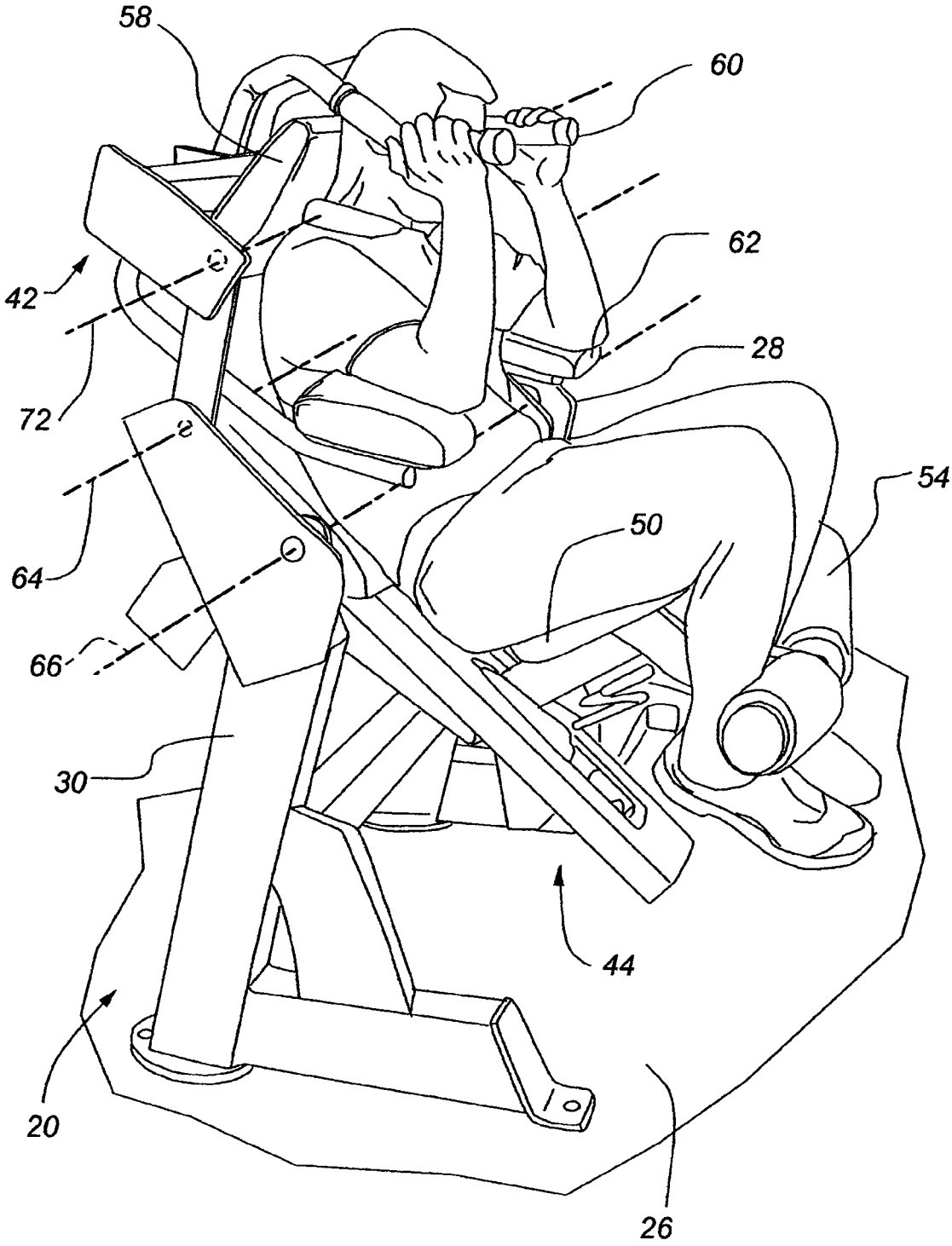
FIG. 5 is a front perspective view of the dual axis abdominal exercise machine of the present invention, in the closed position with a user positioned thereon.

FIG. 3 shows the abdominal machine 20 in the beginning or open position with a user 70 positioned thereon. The user 70 sits on the seat 50 with his lower back against the backrest 52 and lower legs tucked behind the restraining pads 54. The user's upper torso/shoulders rest against the upper pad 58, and his elbows rest on the arm pads 62 while his hands grasp the handles 60. FIG. 4 shows the user 70 in a position intermediate the open and closed position of the machine 20. In FIG. 5, the user 70 is shown in the end or closed position. Note the relative movement of the user's legs and upper torso between FIGS. 3, 4, and 5, during which the abdominal muscles are contracted. The lower carriage 44 rotates around the lower pivot axis 66 on the frame 22, which is in general alignment with the user's hips. The upper carriage 42 rotates around the upper pivot axis 64 on the frame 22, which upper pivot axis 64 being near the user's shoulders. The upper pad 58, arm rests 62 and handlebars 60 articulate while rotating around the upper pivot axis 64 to provide enhanced motion for the upper body of the user 70 during the abdominal crunch exercise. In this articulation, the upper pad 58, arm rests 62 and handlebars 60 pivot about an upper carriage pivot axis 72. The pivot axes shown in FIGS. 5 and 6 extend through the pivot points on one lateral side of the frame 22, and extend through corresponding pivot points on the other lateral side of the frame. The pivot points shown in FIGS. 5 and 6 are basically support pivots for providing stability and side to side coordination to the movement of the upper 42 and lower 44 carriages during use. The four-bar linkage drive systems that coordinate the movement of the upper 42 and lower 44 carriages are found on the upright 28, on the side of the machine opposite that shown in FIG. 5, and are described in greater detail below.

FIG. 6 shows the abdominal exercise machine 20 operably associated with a weight stack machine, such as that shown in U.S. Non-provisional application Ser. No. 11/867,643, filed Oct. 4, 2007, filed concurrently herewith and owned by the assignor of the present invention, and which is hereby incorporated herein by reference. As referenced above, a variety of weight stack machines, or other sources of load for exercising, may be used with this invention. In this configuration, the motion of the four-bar linkage causes a member to rotate the load cam 74 rotatably associated with the frame, which in turn rotates a drive shaft 76 to actuate the load member(s) in the weight stack machine 68. A weight selection device 78 allows the user to select differing weights to use with the dual axis ab crunch machine described herein.

Figure 7A:
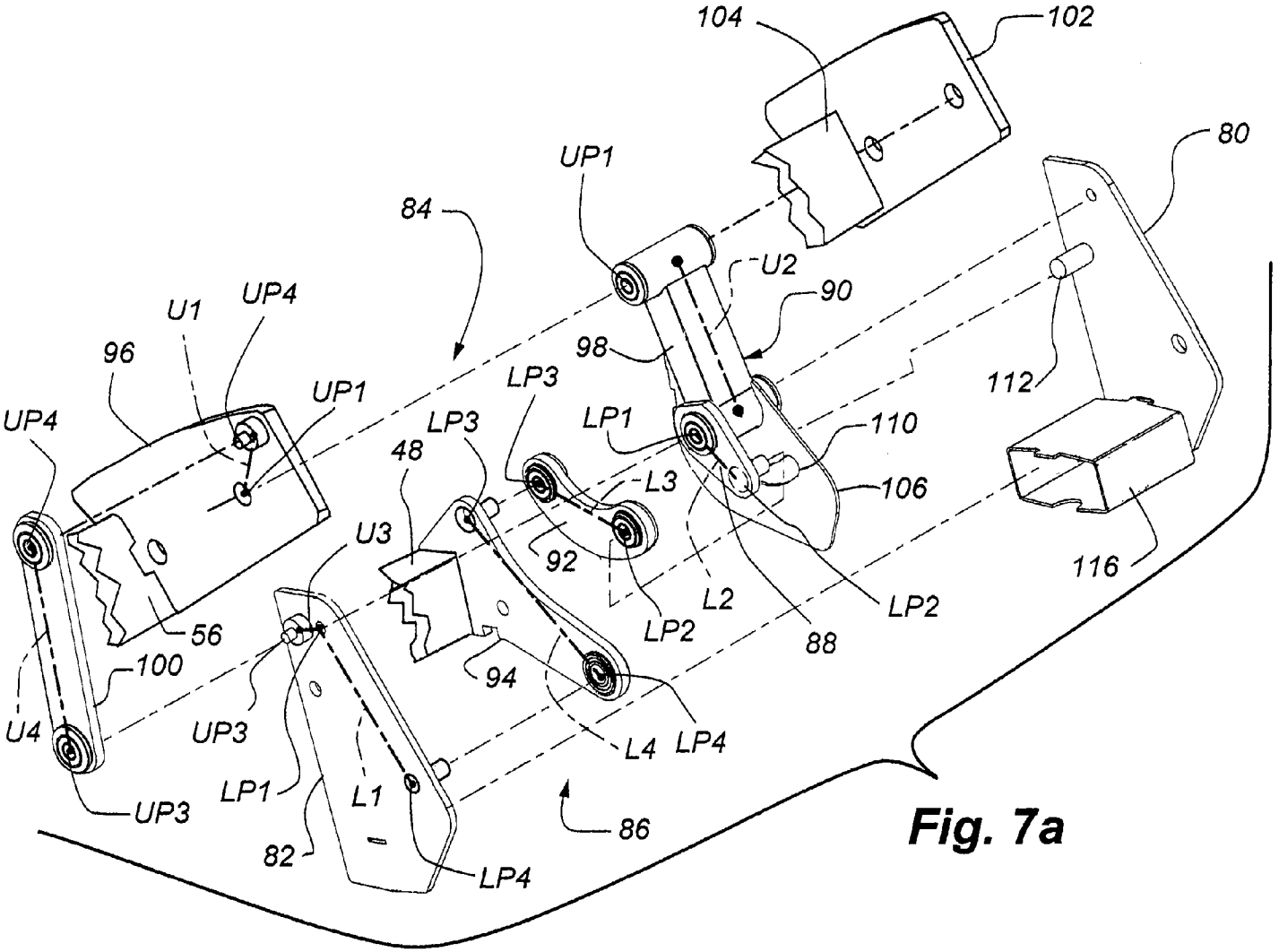
FIG. 7*a* is an exploded view of the four-bar linkage mechanisms for controlling the motion of the upper and lower carriage structures of the dual axis abdominal exercise machine of the present invention.
Figure 7B:
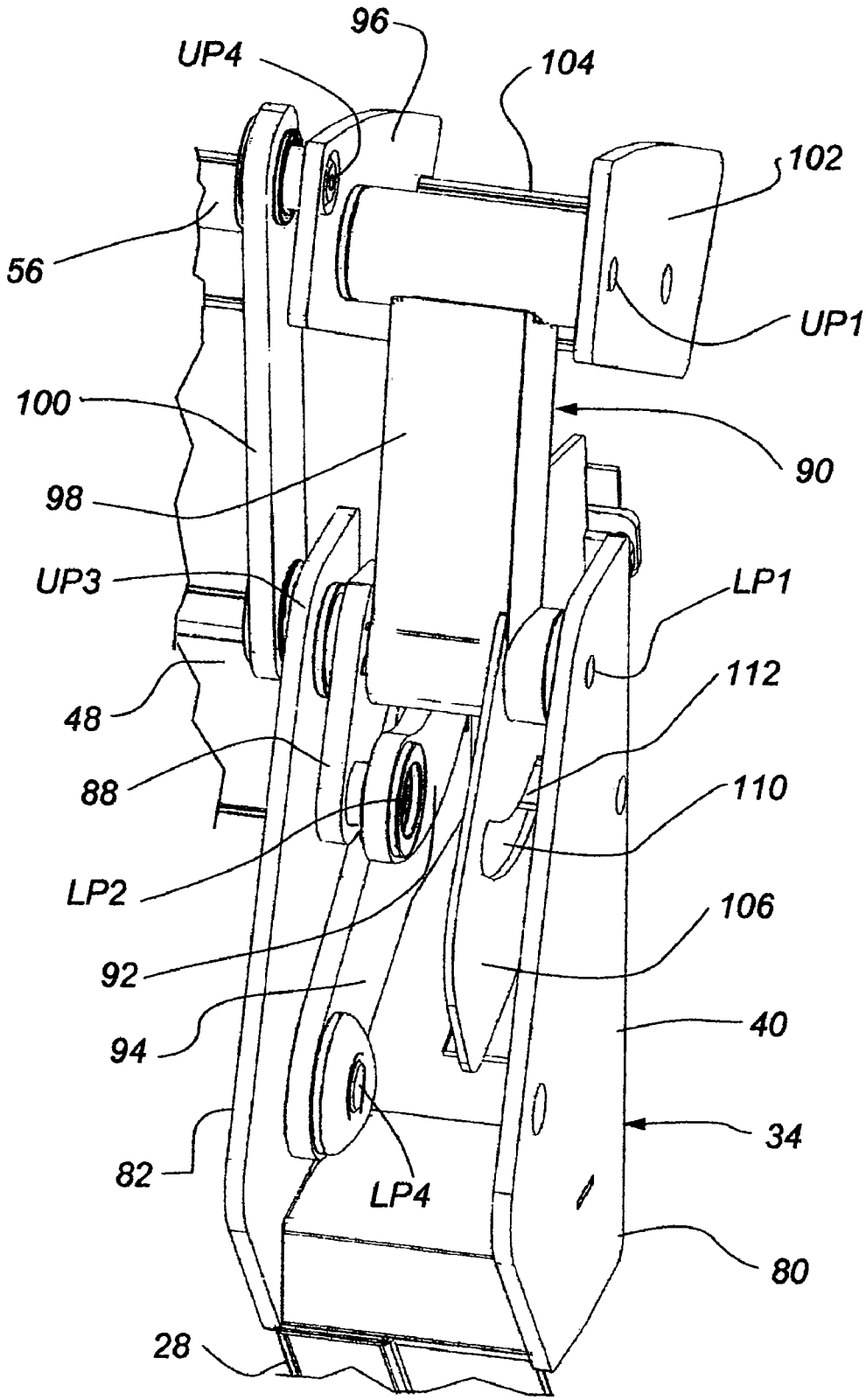
FIG. 7*b* is a front perspective view of the four-bar linkage mechanisms of FIG. 7*a* in an assembled form.
Figure 7C:
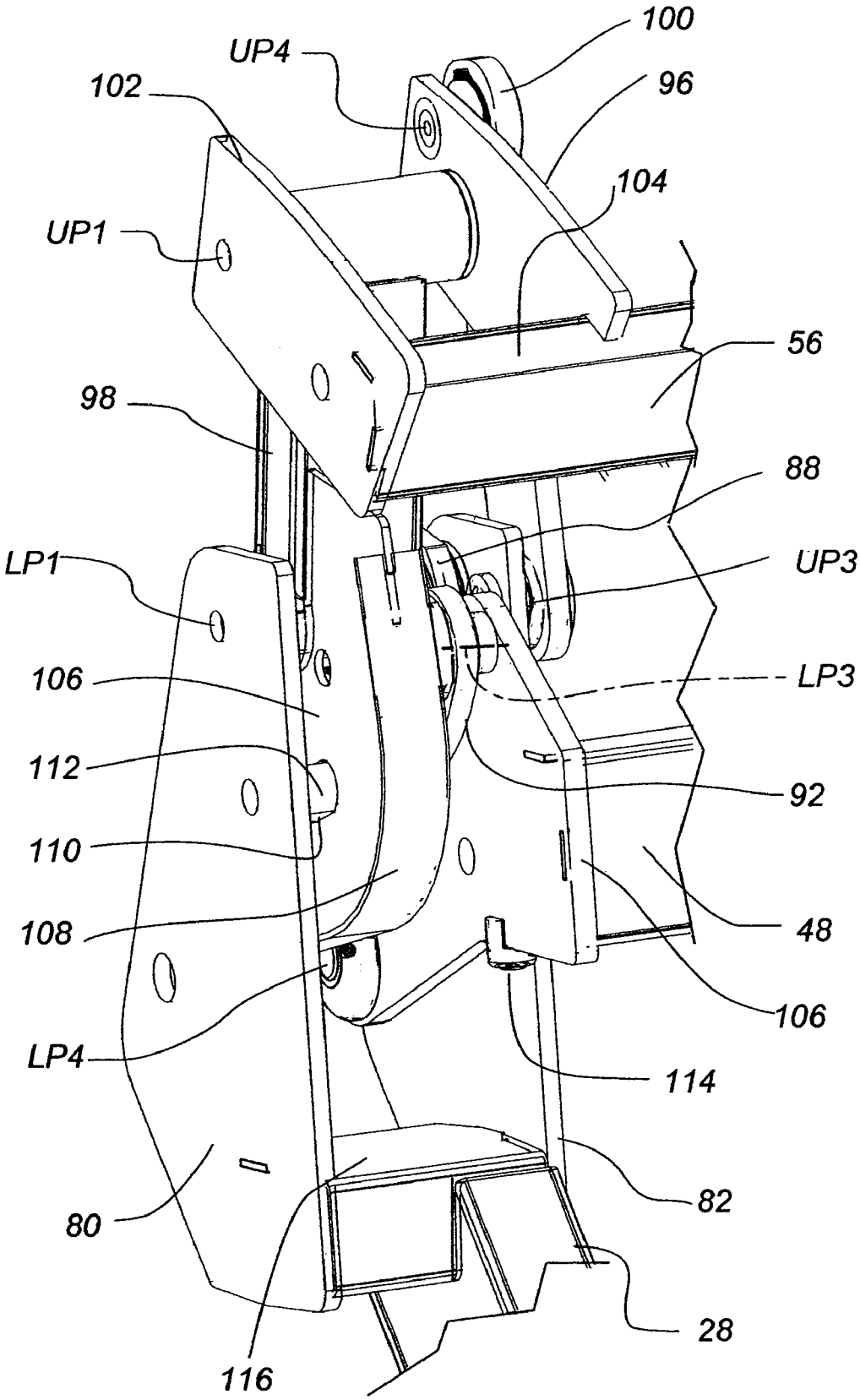
FIG. 7*c* is a rear perspective view of the four-bar linkage mechanisms of FIG. 7*a* in an assembled form.

FIGS. 7*a, b* and *c* show the structure forming the dual four-bar linkage drive mechanisms for the upper 42 and lower 44 carriages in the beginning or open position. FIG. 7*a* shows the dual four-bar linkages in an exploded view. FIG. 7*b* shows the dual four-bar linkages from a front perspective view, and FIG. 7*c* shows the four-bar linkages from a rear perspective view. It should be noted that while four-bar linkage mechanisms are described herein, it is contemplated that other types of mechanisms may be employed as means for causing the carriages to move relative to the frame and relative to one another. Such additional mechanisms include cable and pulley mechanisms, gear mechanisms, or hybrid mechanisms including linkages, gears, cables and pulleys.

In FIG. 7*a*, the top portion 34 of the lateral frame member 28 on the left side of the user, as oriented in FIG. 6, is shown. The dual four-bar linkage system is positioned generally between an outer plate 80 and an inner plate 82 forming the dual plate structure 40 of the lateral frame member 28. Lines representing the effective link structures and the relative pivot points between the link structures for both the upper 84 and lower 86 four-bar linkage mechanisms are super-imposed on FIG. 7*a* for clarity, and to provide a basis for description in later figures.

The four-bar linkage drive mechanism 86 for the lower carriage shown in FIG. 7*a* includes links L1, L2, L3 and L4. L1 is connected to L2 at pivot LP1, L2 is connected to L3 at pivot LP2, L3 is connected to L4 at pivot LP3, and L4 is connected to L1 at pivot LP4. L1 extends between LP4 and LP1, and is formed by the dual plate structure 40 at the upper end of the lateral support post 28. Both LP4 and LP1 are formed on the top portion of the lateral support post 28, and neither of these pivot points move (i.e. translate) during actuation of the lower four-bar linkage drive mechanism 86.

L2 extends between LP1 and LP2 and is the short lever link 88 that serves as the relation mechanism 90 between the lower 86 and upper 84 four-bar linkage drive mechanisms, as is described in greater detail below. L3 extends between LP2 and LP3, and is formed by a curved link 92. L4 extends between LP3 and LP4, and is formed by the lower chassis actuation lever 94 that is part of the structure that movably suspends the lower carriage 44 on the frame 22. A section of the upper cross bar 48 that supports the post 46, seat 50 and back support 52 is shown extending off of the rear portion of the lower chassis actuation lever 94. The configuration of the lower four-bar linkage mechanism 86 in FIG. 7 is in the beginning, or open, position.

The upper four-bar linkage mechanism 84 is also shown in FIG. 7*a*. This mechanism is made up of four link members, U1, U2, U3, and U4. U1 is pivotally connected to U2 at UP1, U2 is pivotally connected to U3 at LP1 (common pivot with the lower mechanism), U3 is pivotally connected to U4 at UP3, and U4 is connected to U1 at UP4.

U1 extends between UP4 and UP1, and is formed by an inner upper carriage plate 96 or link that is part of the structure that movably suspends the upper carriage 42 on the frame. In particular, the inner upper carriage plate 96 forming U1 is part of the structure, including an outer plate 102 and a brace 104, to which is attached the upper pad 58, the arm rests 62, and the handlebars 60. U2 extends between UP1 and LP1, and is formed by a first rocker link 98. U2 is rigidly formed with L2 (in this configuration at an offset angle), with the combination of U2 and L2 pivoting around pivot LP1, which together serve as the relation mechanism 90 between the upper and lower carriages. This will be explained in more detail below. U3 extends between LP1 and UP3, and is a short length formed by the top of the inner plate 96 of the lateral frame portion. LP1 and UP3 do not move during actuation of the four-bar linkage mechanisms. U4 extends between UP3 and UP4, and is formed by a second rocker link 100 that crosses U2, and in part supports and actuates link U1.

The lower pivot axis 66, as shown in FIGS. 3 and 6, extends between LP4 and a corresponding pivot point on the opposing lateral frame member. The upper pivot axis 64 shown in FIG. 3, extends between UP3 and a corresponding pivot point on the opposing lateral frame member. The upper carriage pivot axis 72 extends between UP4 and a corresponding pivot point on the opposing movable member.

The members and pivots shown in FIG. 7*a* are shown assembled in the following drawings, and description of the operation and interaction of the members and pivots is made with reference to the structure described above.

FIG. 7*b* shows a front perspective view of the dual four-bar linkage 84, 86, with the linkages and pivots described above in an assembled condition. The structure is shown where the dual axis abdominal exercise machine is in the open position. Of note in FIG. 7*b* is that the first rocker link 98 (U2) and the short lever link 88 (L2) are in a fixed orientation with each other, and thus form the relation mechanism 90 between the upper 84 and lower 86 four-bar mechanisms. The load actuation plate 106 or lever extends downwardly from the first rocker link 98. The load actuation plate 106, as shown in FIG. 7*c*, has a rear edge 108 that forms a guide for engaging the load strap (not shown) that in turn is operably associated with the weight stack 68, if one is used. As the relation mechanism 90 moves, the load actuation plate 106 moves (for example, rotates around pivot LP1) and lifts or lowers the load, depending on the direction of movement. The load actuation plate 106 defines a curved groove 110 therein. The curved groove 110 is generally aligned around the pivot LP1. A pin 112 extends inwardly from the outer plate 80 and into the groove 110. The pin 112 helps define the outer limit of motion of the four-bar linkages 84, 86, and thus the open and closed positions of the exercise device 20. In the open position, the pin 112 is at or near one end of the groove 110, and as the exercise device 20 is actuated, the load actuation plate 106 moves relative to the pin 112 to position the pin at or near the opposite end of the groove 110. As described later, another, supplemental, stop mechanism 114 (See FIG. 7*c*) may be employed to keep the pin 112 from contacting the second end of the groove 110 and provide a "soft", as opposed to a "hard" final, or closed position. While the load actuation plate 106 is driven by the relation mechanism 90 in this configuration because the relation mechanism provides a solid pivot point with an acceptable leverage benefit and range of motion, it should be understood that it is contemplated that the weight stack 68 may be actuated off of any moving element in the dual four-bar linkage system 84, 86 with the appropriate modifications. Also shown in FIG. 7*b* is a portion of the upper carriage cross bar 56 extending off of the inner 96 and outer 102 upper plates. The upper carriage cross bar 56 supports the head pad 58, arm rests 62 and handles 60.

FIG. 7*c* is a rear perspective view of the dual four-bar linkage mechanisms 84, 86 shown in FIGS. 7*a* and 7*b*. FIG. 7*c* shows the rear edge 108 of the load actuation plate 106, about which the flexible load bearing member curves when the relation mechanism is rotated. An attachment mechanism (not shown) is located at the top of the curved edge to facilitate a secure connection. The attachment mechanism could be a rivet, screw, slot and anchor, or other suitable structure attaching a strap, chain, cable, or the like to the load actuation plate. The curved edge provides for a smooth load profile through the range of motion, and the curved edge may be designed for a desired profile or load effect. The upper carriage crossbar 56 is shown more clearly in FIG. 7*c*. The supplemental stop mechanism 114 may be employed to help define the final, or closed, position of the exercise range of motion. The stop mechanism 114 in this configuration is a rubber bumper mounted on the bottom edge of the load actuation plate 106. As the load actuation plate 106 is rotated about LP1 to its greatest extent, the stop mechanism 114 contacts a member 116 that spaces the inner 82 and outer 80 plates. See at least FIG. 8*a*.

Figure 8A:
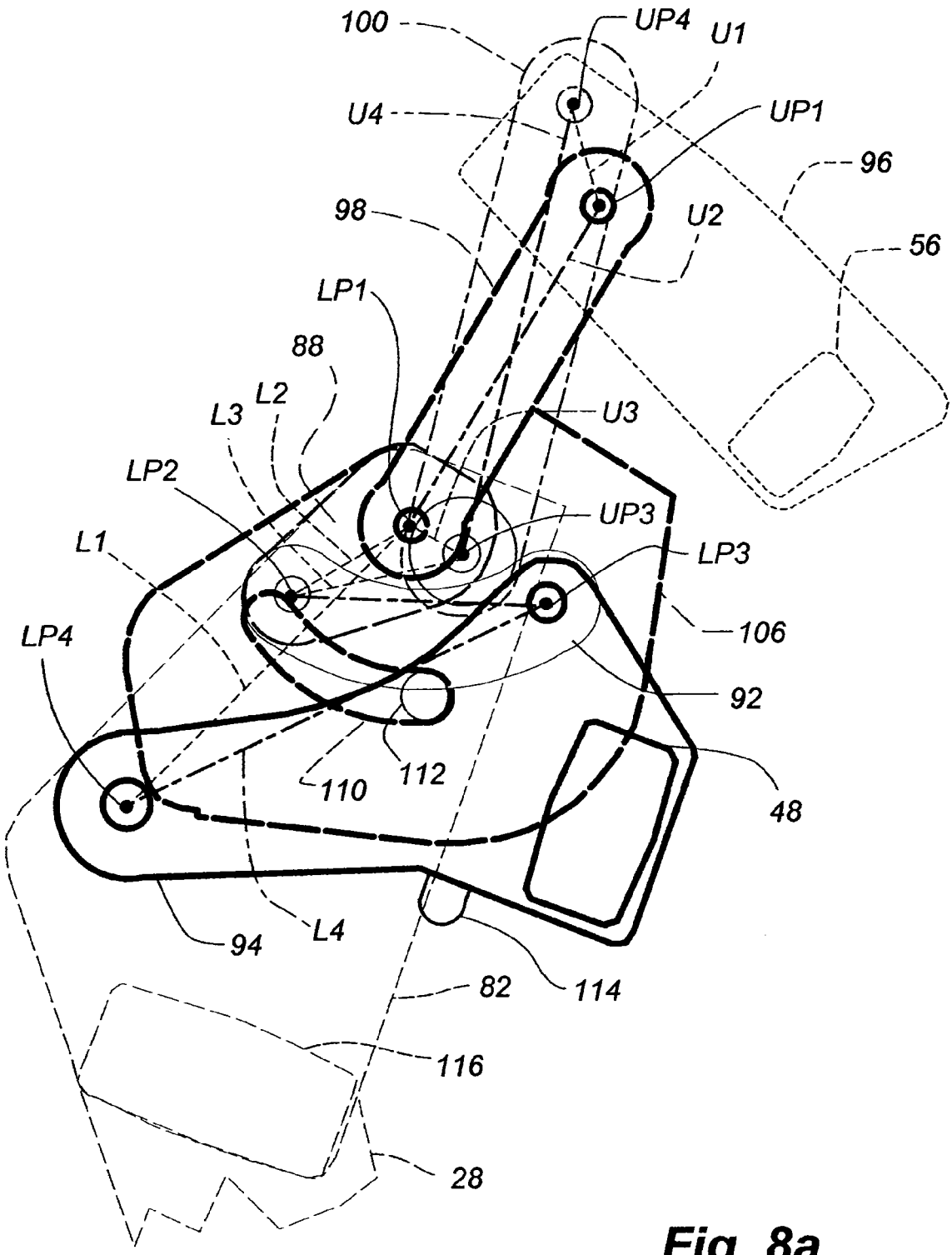
FIG. 8*a* is a combined structural and schematic side view of the dual four-bar linkage mechanism for controlling the upper and lower carriages of the present invention, in the open position.
Figure 8B:
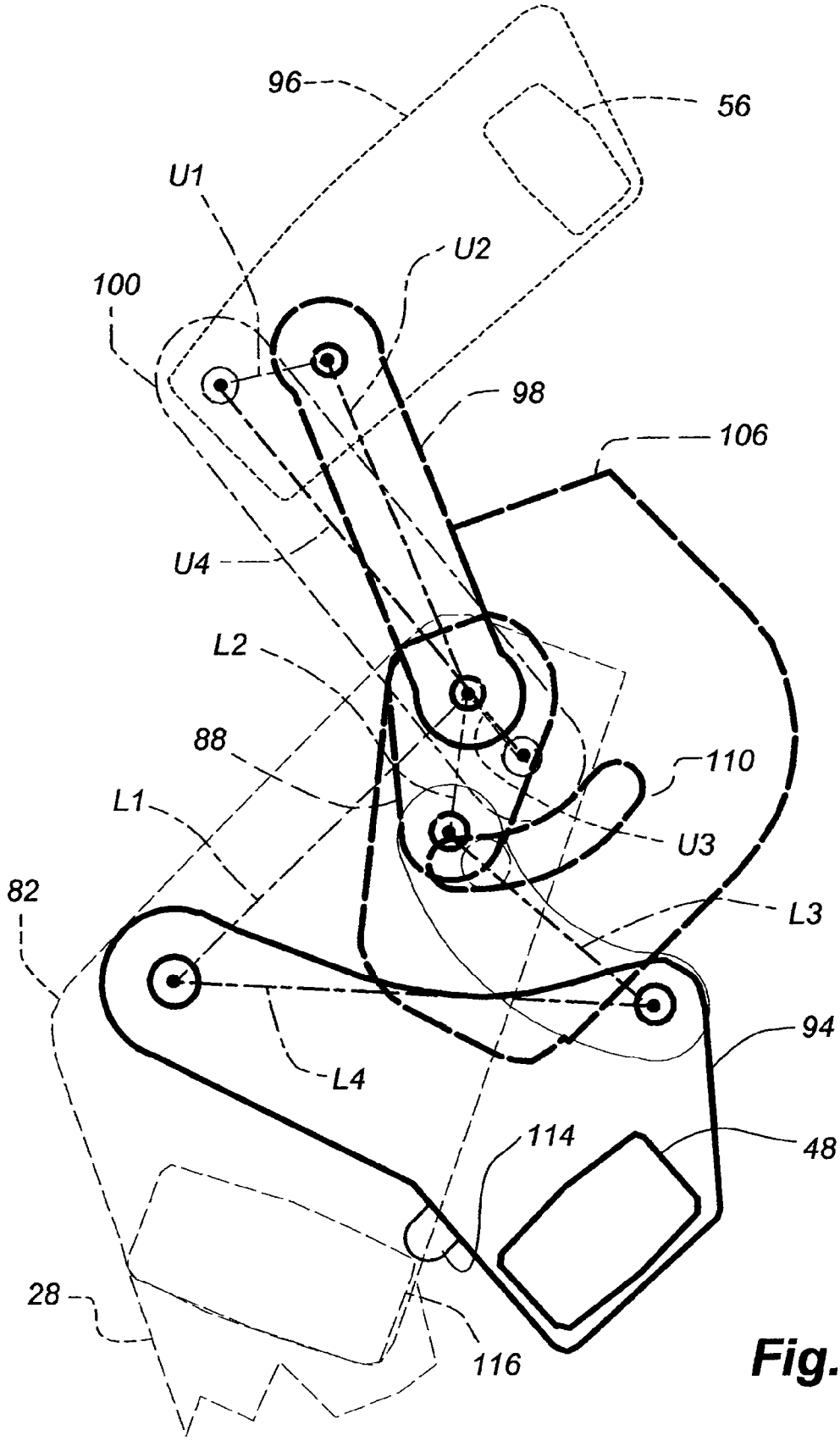
FIG. 8*b* is a combined structural and schematic side view of the dual four-bar linkage mechanism for controlling the upper and lower carriages of the present invention, in the closed position.

FIGS. 8*a* and 8*b* show the structure and schematic links forming the dual four-bar linkage drive mechanisms 84, 86 for the upper and lower carriages in the open position (FIG. 8*a*) and the end or closed position (FIG. 8*b*). In this view, the weight stack is not shown, and an outer plate of the frame is removed for clarity. The links L1, L2, L3, L4 and U1, U2, U3, U4, along with the corresponding pivot points are shown in FIG. 8*a*. FIG. 8*b* only shows the links and for clarity does not refer to the relative pivot points.

Referring to FIG. 8*a*, corresponding to the position shown in FIGS. 1 and 3, in the beginning, or open, position, the lower carriage is relatively vertical (although slightly off-vertical), with the seat 50 roughly parallel to the support surface. The upper pad 58 is in general line with the back pad 52. Through the actuation range of the abdominal exercise machine, the lower carriage 44 and upper carriage 42 change orientation relative to one another and conclude at the end position shown in FIG. 8*b*, which corresponds to the position shown in FIGS. 2 and 5. In the end position, the lower carriage 44 has been rotated upwardly around the lower pivot axis 66 so the back pad 52 is more sloped from vertical, and the seat 50 is angled upwardly a significant amount. The upper carriage 42 has rotated downwardly around the upper pivot axis 64 and the upper carriage axis 72 to cause the upper pad 58 to tilt sharply forward, along with the arm rests 62 and hand grips 60 tilting sharply forward.

The relative motion of the inter-connected upper 84 and lower 86 four-bar linkage mechanisms causes the change in relative orientation between the upper 42 and lower 44 carriages. The motion of the lower carriage 42 is controlled by the motion of the lower four-bar linkage mechanism 86. The motion of the upper carriage 42 is controlled by the upper four-bar linkage mechanism 84. The two four-bar linkage mechanisms 84, 86 are interconnected with one another by the combination link L2/U2, or relation mechanism 90, which itself pivots around pivot LP1, causing the upper 42 and lower 44 carriages to move in concert with one another.

When the user 70 sits in the machine 20 and begins the abdominal exercise, he pushes down with his elbows in the arm pads 62, and pulls up with his legs against the retaining pads 54. This action creates the load on the abdominal muscles of the user, and causes the upper and lower carriages to move relative to one another and relative to the frame.

With reference to FIGS. 8*a* and 8*b*, as the lower carriage 44 is rotated upwardly about the lower pivot axis 66, L1 does not change orientation because it is fixed in the top end of the lateral post 28 of the frame 22. L4, which is formed by the lower carriage actuation lever 94, pivots clockwise around LP4 to the position shown in FIG. 8*b*. The upper crossbar 48 is attached to the lower carriage actuation lever 94, which supports the post 46, seat 50 and back pad 52, thus this assembly swings upwardly as L4 moves. As L4 pivots clockwise about LP4, L3 moves downwardly, changing orientation with respect to both L4 and L2. This causes L3 to pull L2 to pivot around LP1. The changing orientation of L4 causes the lower carriage 44 to pivot to its end position shown in FIG. 8*b* (also FIGS. 2 and 5).

The movement of L2 pivoting around LP1 causes corresponding link U2 of the upper four-bar linkage 84 to pivot counter clockwise around LP1, again with reference to FIGS. 8*a* and 8*b*. L2 and U2 are fixed together as the relation mechanism 90 between the two four-bar linkage structures. As U2 pivots counter clockwise, U4 also moves counter clockwise around UP3. Since LP1 and UP3 do not move during actuation, U2 is forced to move generally counter clockwise, and rotate counter clockwise about its length, to the end position shown in FIG. 8*b*. Given the relative lengths of U2 and U4, and the relative positions of LP1 and UP3, during movement of U2, UP1 moves from right to left (in FIGS. 8*a* and 8*b*) and stays generally at the same height above LP1. UP4, however, moves right to left but also moves significantly downwardly. This causes U1 to translate right to left, and to rotate counter clockwise, which results in the inner 96 and outer 102 upper plates of the upper carriage 42 to pivot a significant amount about UP4 to the end position. In this end position, because U1 is the inner end plate 96 of the upper carriage 42 that suspends the upper torso pad 58, the arm pads 62 and the hand grips 60, these all change orientation along with U1. Thus, the upper carriage 42 rotates generally around the upper pivot axis LP1, and the headrest 58 also rotates around the upper carriage axis UP4, as described above.

The interrelated movement of the lower 44 and upper 42 carriages has been described as being driven by the movement of the lower carriage 44. However, since each are interrelated in this embodiment, the lower carriage 44 movement may be considered as being driven by the upper carriage 42 also. It is also contemplated that the upper 42 and lower 44 carriages may move independently of one another, without the relational mechanism 90. In this instance, the load may be applied to either the upper carriage 42, the lower carriage 44, or both carriages.

With the current configuration, the ratio of the angular deflection of the upper carriage 42 to the angular deflection of the lower carriage 44 is approximately 3:1. For example, if the upper carriage 42 angularly moves approximately 90 degrees between the beginning and ending position, the lower carriage 44 moves approximately 30 degrees. The invention is not limited by this ratio, as many ratios may be selected by the specific design of the movement mechanisms controlling the upper and lower carriages, and may also be selected for a particular range of motion.

Figure 9:
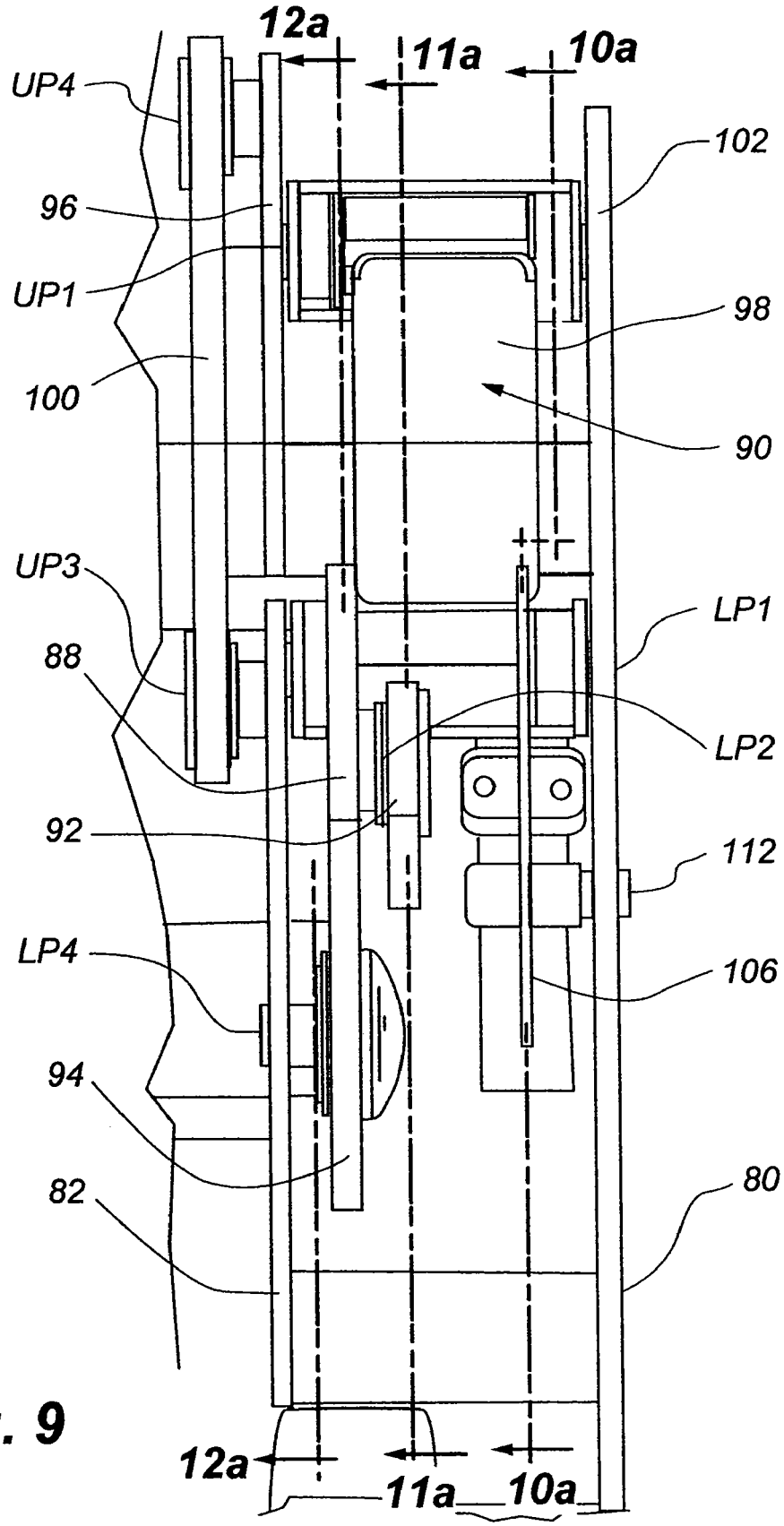
FIG. 9 is a front view of the dual four-bar linkage mechanism structure, in the open position.
Figure 10A:
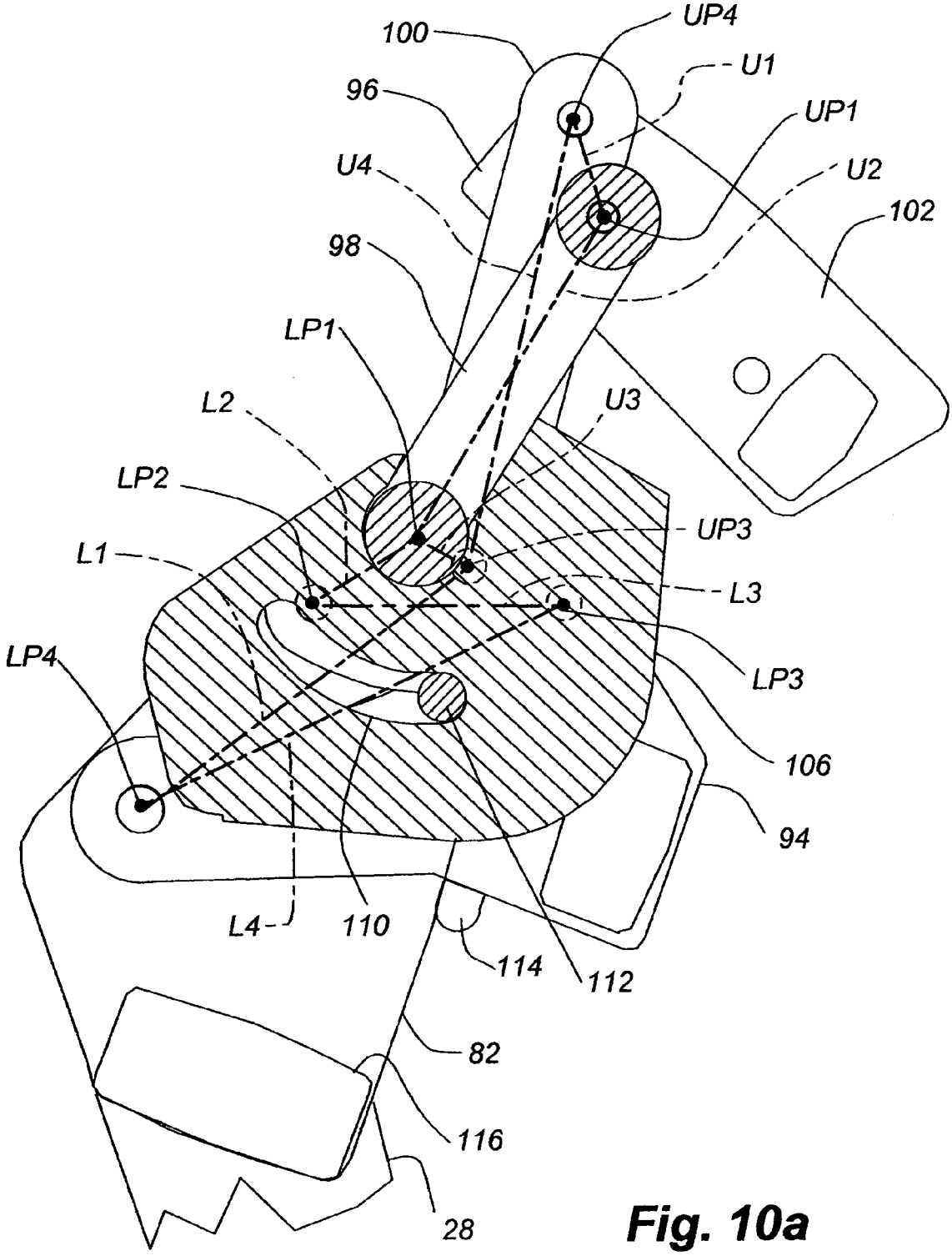
FIG. 10*a* is a section taken along line 10*a*-10*a* of FIG. 9.
Figure 10B:
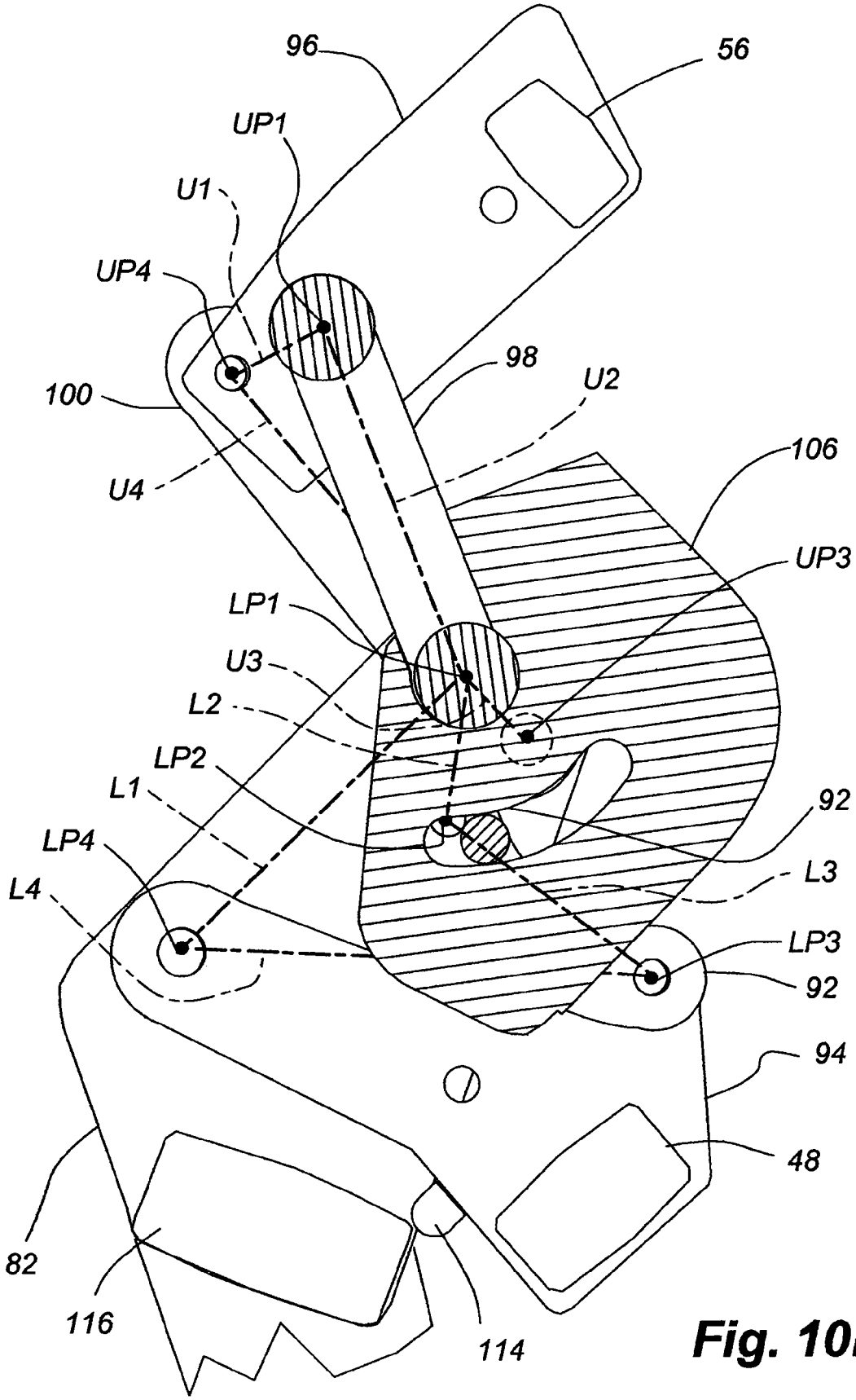
FIG. 10*b* is a representative section similar to FIG. 10*a*, with the dual four-bar linkage mechanism in the closed position.
Figure 11A:
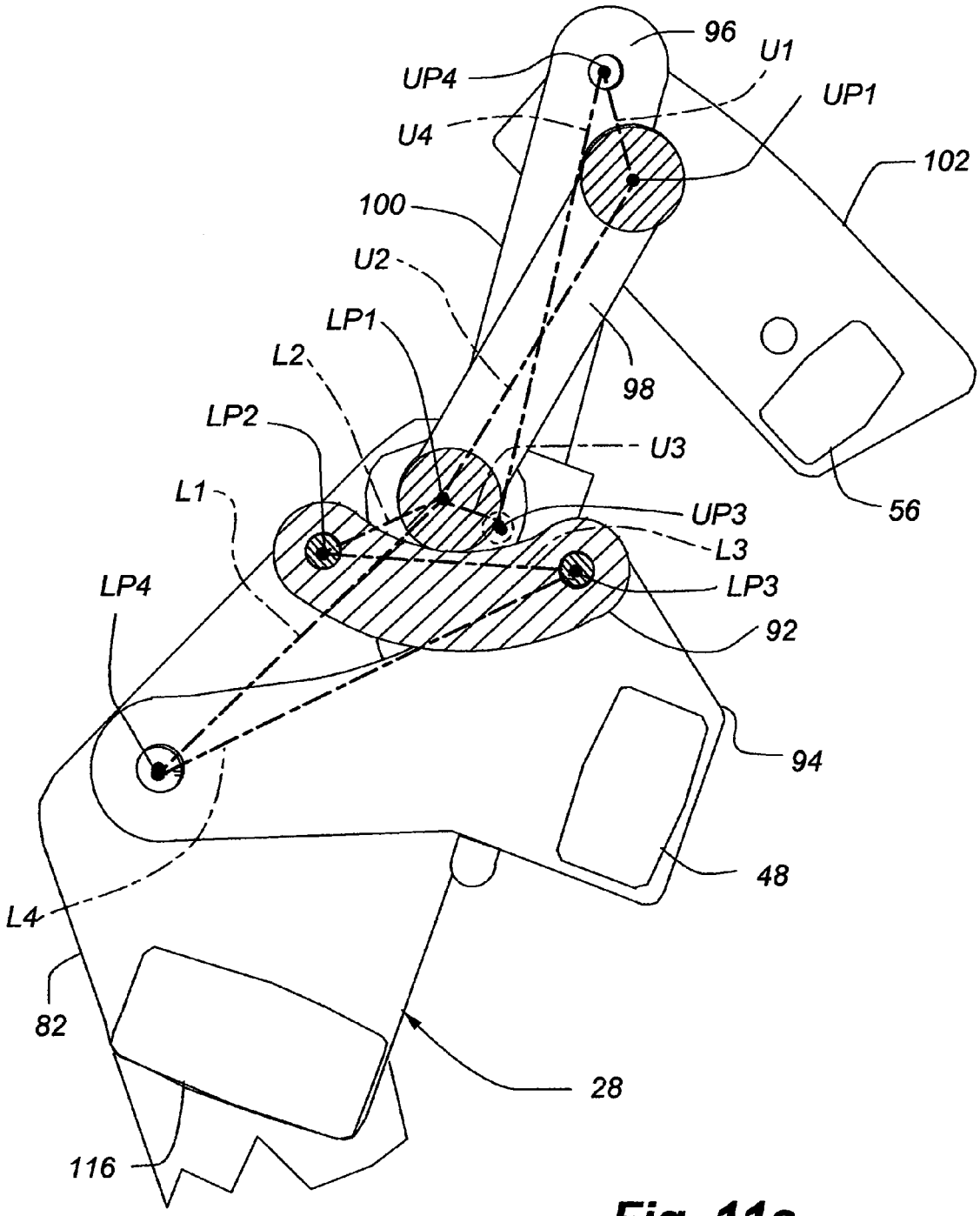
FIG. 11*a* is a section taken along line 11*a*-11*a* of FIG. 9.
Figure 11B:
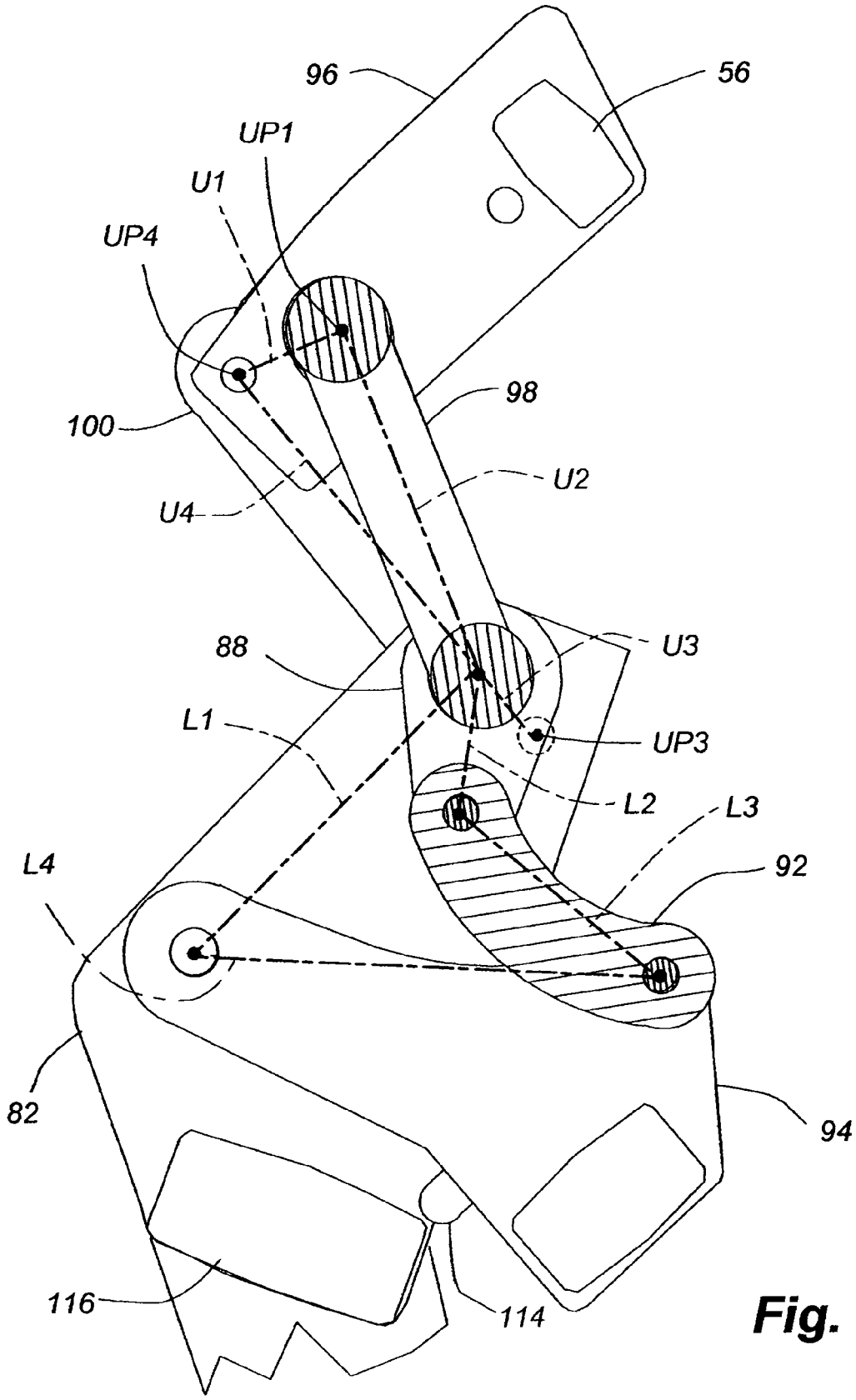
FIG. 11*b* is a representative section similar to FIG. 11*a*, with the dual four-bar linkage mechanism in the closed position.
Figure 12A:
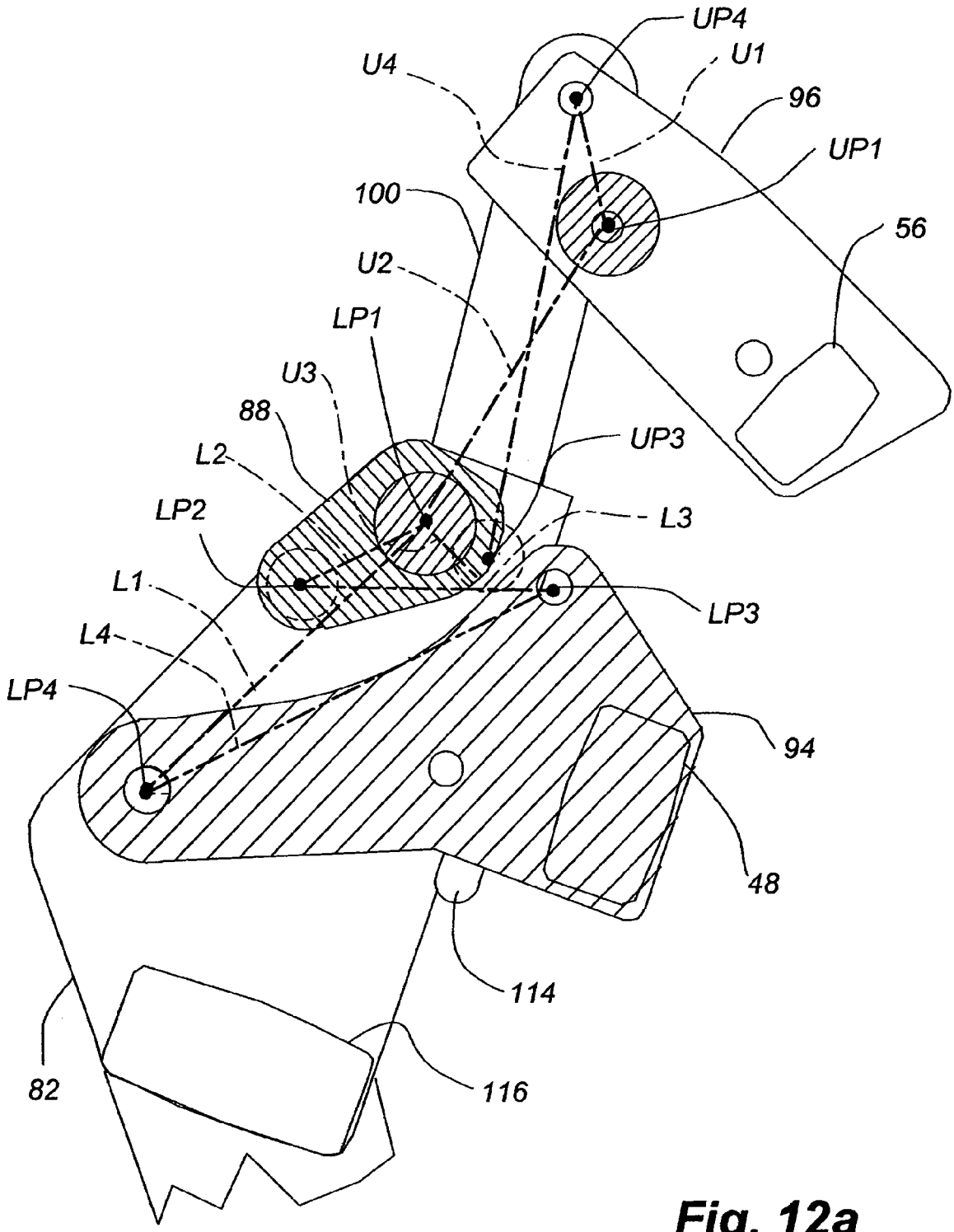
FIG. 12*a* is a section taken along line 12*a*-12*a* of FIG. 9.
Figure 12B:
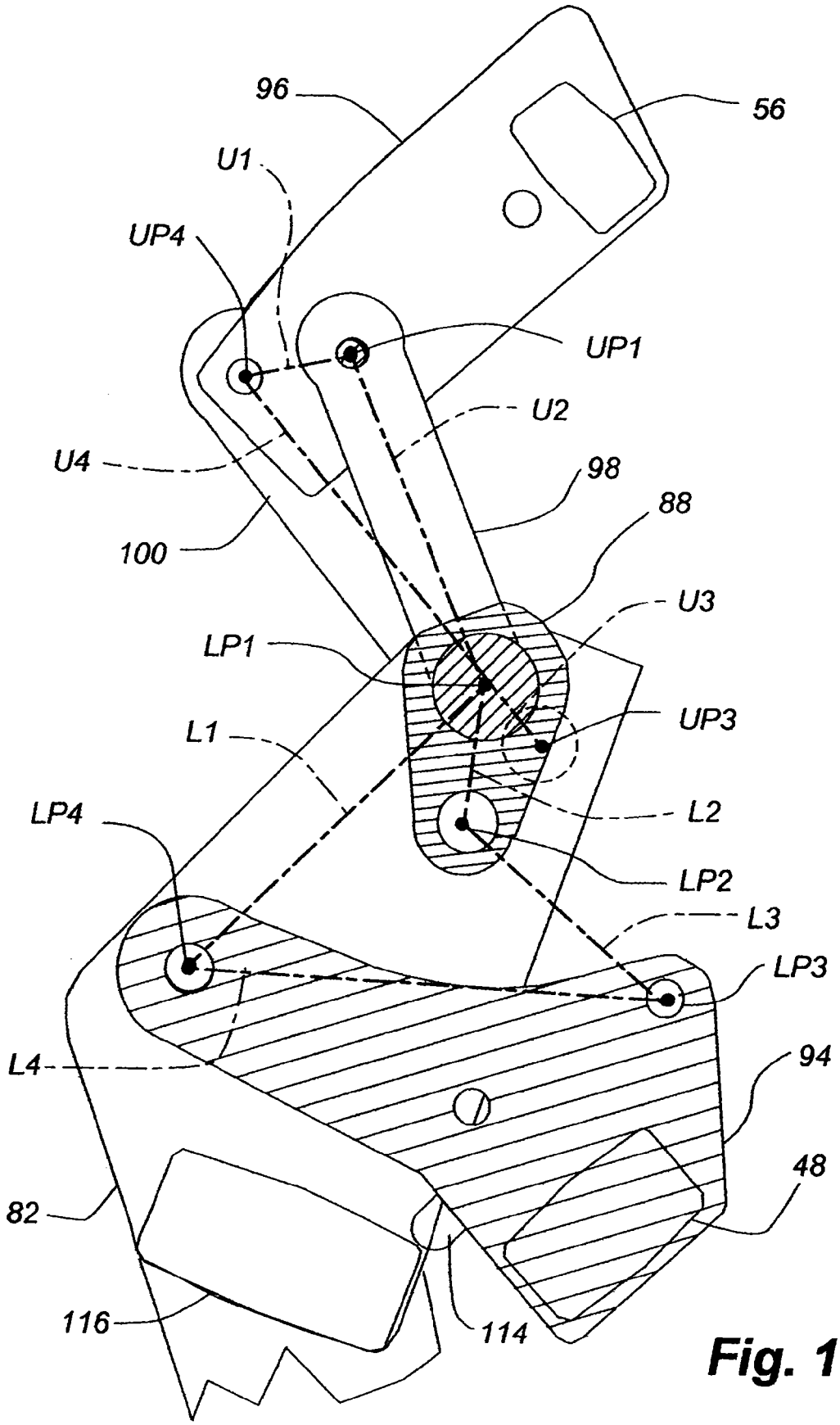
FIG. 12*b* is a representative section similar to FIG. 12*a*, with the dual four-bar linkage mechanism in the closed position.

FIG. 9 is a front view of the dual four-bar linkage systems 84, 86. FIGS. 10*a*, 11*a*, and 12*a* are section views taken from FIG. 9 and show the different layers of the dual four-bar linkage mechanisms 84, 86 in the beginning, or open position. FIGS. 10*b*, 11*b*, and 12*b* are section views taken from FIG. 9 and show the different layers of the dual four-bar linkage mechanisms 84, 86 in the final, or closed, position. The relative movement between the elements of FIGS. 10*a* and 10*b*, 11*a* and 11*b*, and 12*a* and 12*b* are the same as the relative movement between the elements of FIGS. 8*a* and 8*b* as described above. Note in FIG. 10*b* that the supplemental stop mechanism 114 engages the crossbar 116 to define the closed position of the machine 20 before the pin 112 engages the second end of the curved groove 110.

Figure 13:
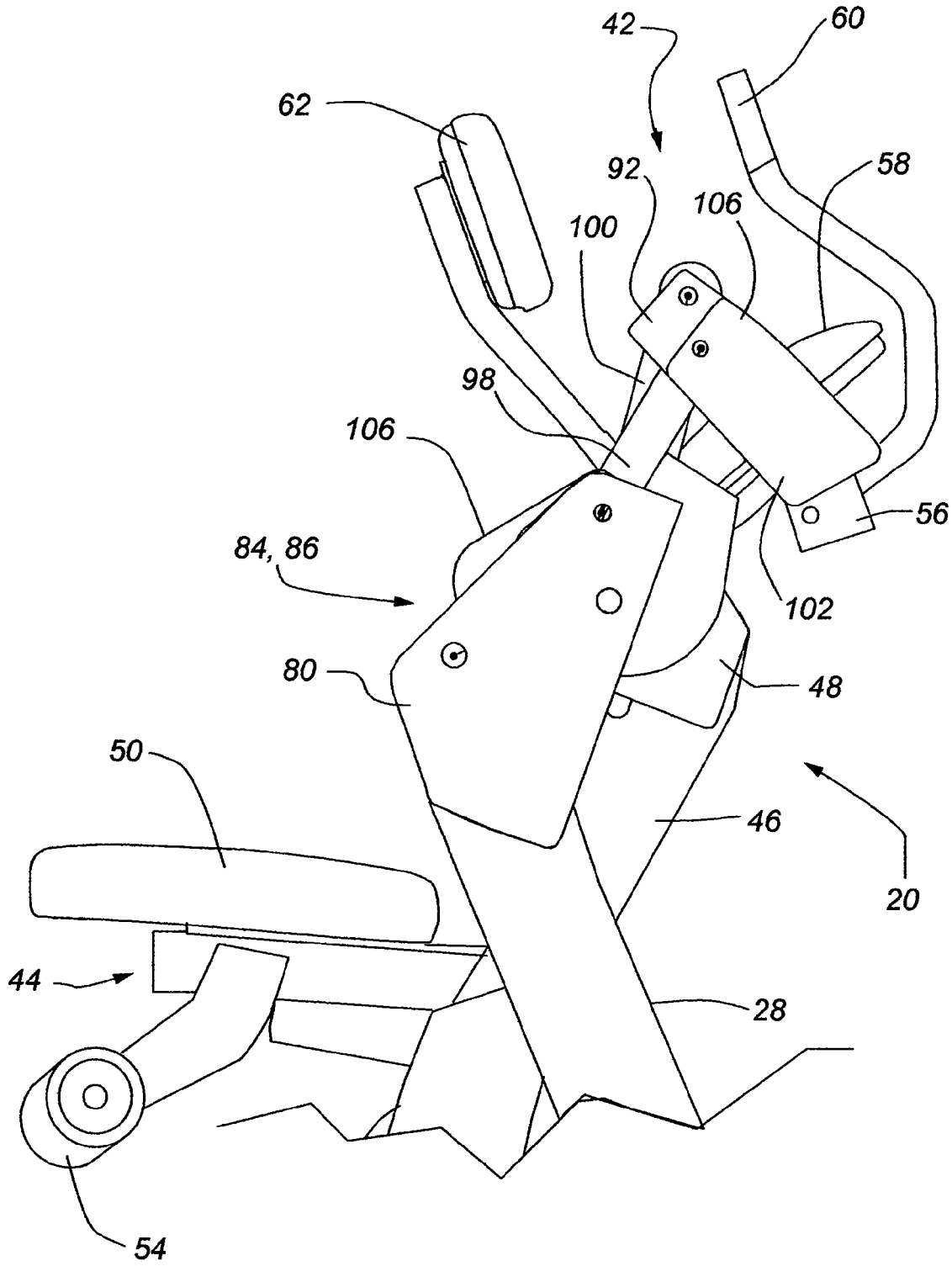
FIG. 13 is a side view of the exercise machine in the open position.
Figure 14:
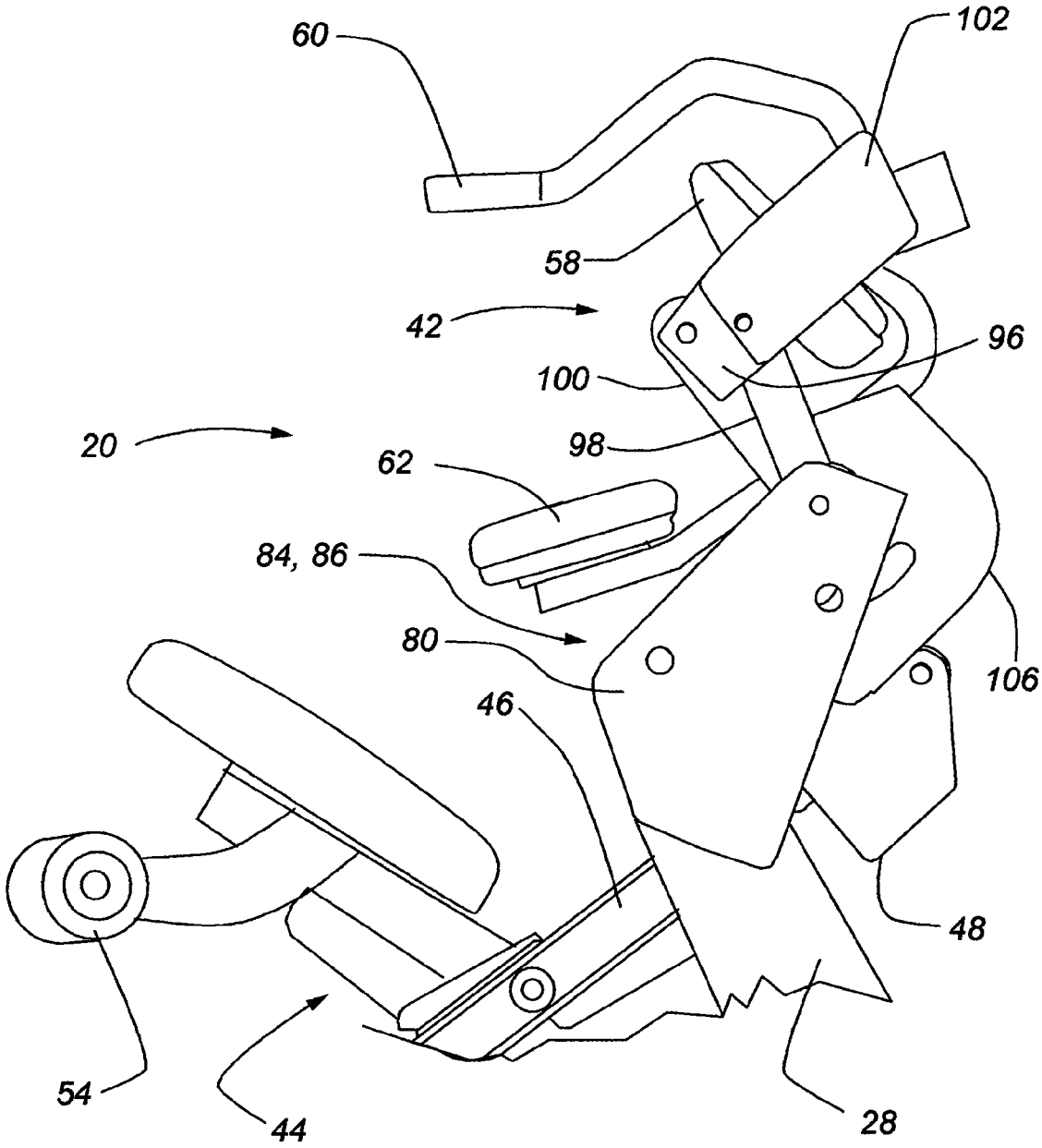
FIG. 14 is a side view of the exercise machine in the closed position.

FIG. 13 shows a side view of the abdominal exercise device in the open position, such as that shown in FIGS. 1, 6, 8*a*, 10*a*, 11*a*, and 12*a*. In this configuration the lower carriage 44 and the upper carriage 42 are positioned to be extended away from one another. FIG. 14 shows a side view of the abdominal exercise device in the closed position, such as that shown in FIGS. 2, 8*b*, 10*b*, 11*b*, and 12*b*. In this position, the lower carriage 44 has moved upwardly in a rotating motion, generally clockwise in this view, around the dual four bar linkage drive structure 84 and 86. The upper carriage 42 has moved to an articulated, generally folded position, generally in a counter-clockwise direction in this view, around the dual four-bar linkage drive structure 84, 86. It is clear that with the particular dual four-bar linkage system as described herein, the upper carriage 42 moves through a larger range of motion than the lower carriage 44, and the upper carriage 42 also articulates, or folds, onto itself as a result of the relative motion of rocker arms 98 and 100, along with endplates 96 and 102.

The dual four-bar linkage mechanisms 84, 86 of the dual axis abdominal exercise device 20 of the present invention provides for a beneficial varying motion of the upper carriage 42 and the lower carriage 44 to closely follow the natural bending motion of a user's spine and hips during the contraction of his abdominal muscles. This provides for a more complete contraction of these core muscles and thus an efficient and effective exercise motion. During the exercise motion between the open and closed position, the upper carriage 42 articulates relative to the frame 22 to more closely match the relatively higher level of curvature of a user's 70 upper back and neck region. The lower carriage 44 moves upwardly in a curved manner to more closely match the relatively lower level of curvature of the user's lower back and hips during the exercise motion between the open and closed position.

Use of the word "pivot" herein is not used in a limiting sense. It is meant to include rotation, fixed pivotal movement, sliding pivotal movement, rotational translation, or other similar motion between two or more elements. Pivotal connections defined herein for the upper and lower four-bar linkage drive mechanisms mould be replaced with sliding, rotating, rolling, fixed, or other operable connections, in any combination, to facilitate control and definition of the movement of the upper and/or lower carriages as desired. Further, the four-bar linkage drive mechanisms may also include fewer or more bars, cams, cables and pulleys, or other structures suitable for controlling the motion of the upper and lower carriages. Further, the upper carriage or lower carriage may be driven for motion with a mechanism other than a four-bar linkage, while the other carriage is controlled by a four-bar linkage. Each four-bar linkage structure may be interpreted as a means for moving or actuating the upper and/or lower carriages.

All directional references (e.g., upper, lower, upward, downward, left, right, leftward, rightward, top, bottom, above, below, vertical, horizontal, clockwise, and counter-clockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

From the above description and drawings, it will be understood by those of ordinary skill in the art that the particular embodiments shown and described are for purposes of illustration only and are not intended to limit the scope of the present invention. Those of ordinary skill in the art will recognize that the present invention may be embodied in other specific forms without departing from its spirit or essential characteristics. References to details of particular embodiments are not intended to limit the scope of the invention.

What is claimed is:

1. An abdominal exercise apparatus comprising:

a frame;

an upper carriage operably associated with said frame;

a lower carriage operably associated with said frame, the lower carriage including a seat;

an upper control mechanism operably associated between said frame and said upper carriage;

a lower control mechanism operably associated between said frame and said lower carriage;

an upper pivot axis defined between said upper carriage and said frame;

a lower pivot axis defined between said lower carriage and said frame;

at least one additional pivot axis defined on said upper carriage; and wherein said upper control mechanism and said lower control mechanism are interconnected to cause said upper and lower carriages to move in concert with one another and with respect to said frame; such that pivotal movement of the lower carriage about the lower pivot axis drives the upper carriage to pivot about the upper pivot axis and drives a portion of the upper carriage to pivot about the at least one additional pivot axis.

2. An abdominal exercise apparatus as defined in claim 1, wherein the upper pivot axis and the lower pivot axis are above the seat.

3. An abdominal exercise apparatus as defined in claim 1, further comprising:

a load assembly operably associated with either of said upper or lower carriages to apply a load when said exercise apparatus is used.

4. An abdominal exercise apparatus as defined in claim 1, wherein:

said upper carriage includes a pad and arm rests.

5. An abdominal exercise apparatus as defined in claim 4, wherein:

said pad and said arm rests move as a unit relative to said upper carriage.

6. An abdominal exercise apparatus as defined in claim 1, wherein:

said upper and lower control mechanisms are linkages.

7. An abdominal exercise apparatus as defined in claim 1, wherein:

said upper and lower control mechanisms are four-bar linkage mechanisms.

8. The invention as defined in claim 1, wherein:

said upper control mechanism and said lower mechanism share a common pivot point.

9. The invention as defined in claim 1, wherein:

said upper control mechanism and said lower control mechanism share a common member.

10. The invention as defined in claim 1, wherein:

said upper control mechanism includes at least one member;

said lower control mechanism includes at least one member;

said upper control mechanism and lower control mechanism share a common pivot point;

one of said at least one member of said upper control mechanism and one of said at least one member of said lower control mechanism form a common member; and wherein said common member is pivotally connected to said frame.

11. The invention as defined in claim 10, wherein:

a portion of said common member drives said lower control mechanism; and a portion of said common member drives said upper control mechanism.

12. The invention as defined in claim 10, wherein:

a load is actuated by motion of said common member.

13. An abdominal exercise apparatus comprising: a frame;

an upper carriage operably associated with said frame;

a lower carriage operably associated with said frame, the lower carriage including a seat;

an upper four-bar linkage mechanism operably associated between said frame and said upper carriage;

a lower four-bar linkage mechanism operably associated between said frame and said lower carriage;

said upper and lower four-bar linkage mechanisms sharing a common member, said member pivotally attached to said frame;

a load actuated by the motion of said common member;

the upper carriage configured to pivot relative to the frame around a first pivot axis;

the lower carriage configured to pivot relative to the frame around a second pivot axis;

a portion of the upper carriage configured to pivot around a third pivot axis, the third pivot axis defined on said upper carriage; and the upper and lower four-bar linkage mechanisms are interconnected such that pivotal movement of the lower carriage about the second pivot axis drives the upper carriage to pivot about the first axis and drives the portion of the upper carriage to pivot about the third pivot axis.

14. An abdominal exercise apparatus as defined in claim 13, wherein:

upon actuation from an open position to a closed position, said upper carriage articulates more than said lower carriage.

15. An abdominal exercise apparatus comprising:

a frame including opposing upright posts;

an upper carriage operably associated with said opposing upright posts;

a lower carriage operably associated with said opposing upright posts and including a seat;

an upper four-bar linkage mechanism operably associated between one of said posts and said upper carriage;

a lower four-bar linkage mechanism operably associated between one of said posts and said lower carriage;

said upper and lower four-bar linkage mechanisms sharing a common member, said member pivotally attached to said frame; and a load actuated by the motion of said common member;

the upper carriage configured to pivot relative to the frame around a first pivot axis;

the lower carriage configured to pivot relative to the frame around a second pivot axis;

a portion of the upper carriage configured to pivot around a third pivot axis, the third pivot axis defined on said upper carriage; and the upper and lower four-bar linkage mechanisms are interconnected such that pivotal movement of the lower carriage about the second pivot axis drives the upper carriage to pivot about the first axis and drives the portion of the upper carriage to pivot about the third pivot axis.

16. An abdominal exercise apparatus as defined in claim 15, wherein:

said opposing upright posts each define bottom portions that extend rearwardly and upwardly from a base frame, and upper portions that extend generally upwardly from said bottom portions; and said upper and lower carriages operably associated with said upper portions of said upright posts.

17. The abdominal exercise apparatus of claim 13, wherein:

the first pivot axis is located above the second pivot axis; and the second pivot axis is located above the seat.

18. The abdominal exercise apparatus of claim 15, wherein:

the first pivot axis is located above the second pivot axis; and the second pivot axis is located above the seat.

* * * * *